US011142969B2

(12) United States Patent
Neuville et al.

(10) Patent No.: US 11,142,969 B2
(45) Date of Patent: Oct. 12, 2021

(54) TUBULAR STAND BUILDING CONTROL SYSTEMS AND METHODS

(71) Applicant: Frank's International, LLC, Houston, TX (US)

(72) Inventors: Dax Neuville, Broussard, LA (US); Brian Begnaud, Lafayette, LA (US); Cory Cole, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 52 days.

(21) Appl. No.: 16/670,710

(22) Filed: Oct. 31, 2019

(65) Prior Publication Data

US 2020/0149361 A1 May 14, 2020

Related U.S. Application Data

(60) Provisional application No. 62/758,130, filed on Nov. 9, 2018.

(51) Int. Cl.
*E21B 19/16* (2006.01)
*E21B 19/06* (2006.01)
*E21B 19/10* (2006.01)

(52) U.S. Cl.
CPC ..... *E21B 19/165* (2013.01); *E21B 19/06* (2013.01); *E21B 19/10* (2013.01)

(58) Field of Classification Search
CPC ..... E21B 19/165; E21B 19/06; E21B 19/10; E21B 44/00
See application file for complete search history.

(56) References Cited

U.S. PATENT DOCUMENTS

2002/0170720 A1* 11/2002 Haugen ..... E21B 19/00 166/379
2016/0076318 A1* 3/2016 Larkin ..... E21B 19/06 166/75.11

FOREIGN PATENT DOCUMENTS

CA 2446687 A1 11/2002
WO 2008/134581 A2 11/2008

OTHER PUBLICATIONS

Extended European Search Report dated Apr. 1, 2020, EP Application No. 19207910, pp. 1-8.

* cited by examiner

*Primary Examiner* — Giovanna Wright
*Assistant Examiner* — Yanick A Akaragwe
(74) *Attorney, Agent, or Firm* — MH2 Technology Law Group LLP

(57) ABSTRACT

Methods and systems for controlling a stand-building process of which the method includes engaging a first tubular using an elevator, hoisting the first tubular by raising the elevator, lowering the first tubular into a spider by lowering the elevator, engaging the first tubular using the spider, disengaging the first tubular from the elevator after engaging the first tubular using the spider, engaging a second tubular using the elevator, hoisting and lowering the second tubular into engagement with the first tubular, connecting together the first and second tubulars, and disengaging the spider from the first tubular after connecting together the first and second tubulars. At all times during the stand-building process, a sequential step control system locks an open/close control of the elevator control, or locks an open/close control of the spider control, or locks both, depending on a step of the stand-building process being performed.

15 Claims, 31 Drawing Sheets

TUBULAR STAND BUILDING CONTROL SYSTEMS AND METHODS

CROSS-REFERENCE TO RELATED APPLICATIONS

This application claims priority to U.S. Provisional Patent Application having Ser. No. 62/758,130, which was filed on Nov. 9, 2018 and is incorporated herein by reference in its entirety.

BACKGROUND

In the oil and gas industry, drill strings and casing strings (referred to herein as "tubular strings") are each made up of a series of tubulars (e.g., pipes) and are used to bore into the earth, complete the well, and produce hydrocarbons therefrom. The tubulars are connected together end-to-end, either directly or via a coupling. As the tubular string is deployed farther into the wellbore, additional tubulars are added to the tubular string. Drilling rigs thus include a variety of systems (e.g., elevators, top drives, spiders, etc.) that support the deployed section of the string, while threads of a new tubular (or stand of tubulars) are engaged with the threads of the upper-most connection of the deployed string. The new tubular is then rotated until a secure connection is made, resulting in the new tubular becoming part of the string. The now-longer string is then advanced into the wellbore, and the process may be repeated.

In the past, running tubulars was done one length ("joint") of tubular at a time. A typical setup for this type of tubular running is shown in FIG. 1. A single joint ("auxiliary") elevator 116 was used to engage and hoist a tubular from a non-vertical (e.g., horizontal) position, raise it to a vertical position above well center, and lower it through a spider 112 formed at the rig floor. The auxiliary elevator 116, primary elevator 120, and spider 112 may be either manipulated manually, or powered and controlled locally, or powered and controlled remotely. Once sufficiently lowered, slips (or other gripping structures) of the spider 112 engage the tubular string 108 and hold it in place. The auxiliary elevator 116 then disengages from the tubular joint, engages an add-on tubular joint 110, and again hoists it into the vertical position, this time above the previously-run tubular joint 108, now supported in the spider. The add-on tubular 110 is threaded into connection with the previously-run tubular 108. At this point, the weight of the add-on tubular, in addition to the previously-run tubular joint, which together now form a tubular string, can be supported by the spider, and thus the auxiliary elevator can be disengaged. The primary elevator 120 is then moved into position for engagement with the top-most (add-on) tubular joint 110, the slips of the elevator grip the joint and the spider is opened, allowing the primary elevator 120 to support the weight of the tubular string. The primary elevator 120 then lowers the tubular string through the spider 112, until the primary elevator 120 is directly above the spider 112, at which point the spider 112 closes, engaging the add-on tubular 110. The primary elevator 120 then disengages, and the process of adding a new tubular similar to 110 to a previously-run string is repeated until the desired length of tubular string is run into the wellbore.

With the spider and elevator being opened and closed many times throughout the process, the possibility exists that both devices may be unintentionally opened at the same time, allowing the tubular string to drop in an unintended, uncontrolled manner.

To mitigate this risk, an interlock system 104 may be provided to prevent the spider 112 and the primary elevator 120 from both opening at the same time. The interlock system 104, however, is generally provided with an interlock system bypass, which enables either the spider 112 or the primary elevator 120 to be opened without first acquiring a confirmation signal that the companion tool is first engaged on the tubular. There may be variations of interlock systems (logic-based and feedback-based) that may bypass all grip safeguards and enable both the spider 112 and the primary elevator 120 to be opened at the same time when the interlock system bypass is engaged. Generally, the auxiliary elevator 116 is independent of the interlock system 104 for the spider 112 and the primary elevator 120, and thus may be independently opened and closed without regard to the state of either of the spider 112 or primary elevator 120. In the earlier conventional tubular running process, the interlock bypass may only have been needed when the first joint was run through the spider 112, because neither the primary elevator 120 nor the spider 112 are gripping the tubular until after the first tubular is run partially through the spider 112, and because some tools, when closed, provide no feedback signal, since no tubular is being gripped. Thereafter, the interlock system 104 may be used, as either the primary elevator 120 or the spider 112 is gripping a tubular at all times. Since the string is run one length at a time into the wellbore, this means the interlock system 104 is only bypassed once, at the very beginning of the tubular running process.

This process of running single tubular joints, one at a time, and pausing to connect each new joint can be time consuming, because there may be many such tubulars that are run as part of the string to form the wellbore. Accordingly, two or more tubular joints are often connected together into "stands" before or in parallel to tubular running/drilling operations. The stands are stored, e.g., in a vertical orientation in a storage rack within the derrick, for subsequent connection to the operative tubular string and deployment into the wellbore. Thus, the number of times that drilling or casing running must be stopped to attach a new length of tubular is reduced, since the length of the stands is generally double, triple, quadruple or more than the length of a single tubular.

The equipment for building of a stand is similar to the running of tubulars discussed above, except that the primary elevator may be omitted, as the weight being supported (a stand versus potentially thousands of feet of tubular string) is much less. Thus, a spider and an auxiliary elevator may support stand-building operations, without the primary elevator. In addition, the stand may be built using a mouse hole or auxiliary rotary in which the tubular joints are lowered, with the spider positioned at the top of the mouse hole or auxiliary rotary, rather than the operative rotary over the wellbore.

An example of a stand building sequence is shown in FIGS. 2A-2P. At 202, a joint of tubular 250 is picked up, e.g., from a non-vertical (e.g., horizontal) orientation using an auxiliary elevator 252, and is hoisted to a vertical orientation and above a spider 254. The slips of the spider 254 are opened to receive the joint 250, as at 204, and the joint 250 is then lowered into the wellbore through the spider, as at 206. The slips of the spider 254 then close, such that the tubular joint 250 is supported by the spider 254. The elevator 252 then disengages from the tubular 250 at 208 and grips another tubular 256 at 208.

The second tubular 256 is then likewise hoisted and brought into vertical orientation above the spider 254, as at 210. The elevator 252 lowers the second tubular 256 so that the lower threaded connection portion thereof is brought into engagement with the upper threaded connection portion of the first tubular 250, and tongs or other tubular rotating devices operate to thread the second tubular into connection with the first tubular as at 212.

The spider 254 then releases, as at 212, and the elevator 252 lowers the now combined first and second tubulars 250, 256 further into the well. Once the partial stand is lowered sufficiently (e.g., when the elevator 252 is directly above the spider 254), the slips of the spider 254 are once again closed, as at 214, and the spider 254 grips the second tubular. The elevator 252 then disengages. The previous process is repeated, as at 216,218,220, until a stand 260 of a desired number of tubular joints is built. Once completed, the elevator 252 may operate to hoist the completed stand 260 out of the mouse hole (or well), and tubular handling equipment (e.g., pipe racking system) 262 on the drilling rig may be used to position the stand in a rack ("rack back"), or otherwise store the stand for future use, as shown at 222, 224, 226.

Like the single-joint running process, the stand-building process may also involve an interlock, ensuring that the elevator 252 or the spider 254 grips the stand 260 as it is built so that the companion tool can open, and/or that both the elevator 252 and the spider 254 are not open at the same time.

However, the potential for user error, despite the provision of an interlock, is greater in stand-building than single-joint running. For example, at 210 and at 218, the elevator 252 is in the closed position on a single tubular joint 256 and the spider 254 is closed on another tubular (either the joint 250 at 210 or the partially assembled stand 258 at 218). As such, each of the elevator 252 and the spider 254 provides a closed feedback signal. Since both signals are apparent, the interlock, which may prevent both tools from being open at the same time, thus permits either the spider 254 or the elevator 252 to be opened. This allows the control system operator the opportunity to open one of the spider 254 or elevator 252 before thread makeup is completed by the tong operation. This may result in uncontrolled release of either the joint held by the elevator 252 or the joint or partial stand held by the spider 254.

In addition, when both tools 252, 254 are closed, either can be opened according to the interlock system, but the operator may lose awareness in the semi-repetitive sequence. For example, the user may mistakenly believe he is picking up the first joint 250 in the next stand to be assembled (e.g., at 202), which calls for the spider 254 to be opened to receive the first joint 250, but in reality the operator may be picking up one of the subsequent joints (e.g., joint 256 at 210 or joint 259 at 218) to continue building an incomplete stand. As a result, the operator may open the spider 254 while it was still supporting a partially assembled stand, and the stand drops uncontrolled through the spider, as at 228 and 230.

Further, to transfer a completely assembled stand 260 to the rig's pipe racking system 262, the spider 254 may be closed without having a tubular present in order for the interlock system to permit opening of the elevator 252. Often the interlock system does not need to be switched to bypass mode to open the elevator 252, but with feedback-based interlocks, if the spider 254 is not closed onto a tubular, the bypass mode needs to be enabled. If bypass mode is enabled, the operator may potentially release the elevator 252 from the stand 260 prior to the tubular handling equipment 262 supporting the stand 260, as at 232, and/or may fail to disable bypass mode, putting future hoisting operations at risk.

Thus, there is a need for an improved tubular stand building control system and methods that avoid or at least mitigate the risks of uncontrolled release of the add-on tubulars or the stands.

SUMMARY

A method for controlling a stand-building process using a sequential step control system is disclosed. The method includes engaging a first tubular using an elevator, hoisting the first tubular by raising the elevator, lowering the first tubular into a spider by lowering the elevator, engaging the first tubular using the spider, disengaging the first tubular from the elevator after engaging the first tubular using the spider, engaging a second tubular using the elevator, hoisting and lowering the second tubular into engagement with the first tubular, connecting together the first and second tubulars, and disengaging the spider from the first tubular after connecting together the first and second tubulars. At all times during the stand-building process, the sequential step control system locks an open/close control of the elevator control, or locks an open/close control of the spider control, or locks both, depending on a step of the stand-building process being performed.

A control system for building stands on a drilling rig is disclosed. The system includes a control panel comprising a spider control configured to control an opening and closing of a spider, and an elevator control configured to control an opening and closing of an elevator, a drum having a plurality of camming surfaces, an actuator coupled to the drum, such that the actuator is configured to rotate the drum about a central axis. The actuator is configured to respond to a feedback signal so as to actuate in a first direction, and the actuator is configured to respond to a step-advance command so as to actuate in a second direction. The system also includes a linkage coupling the actuator to the drum, such that the linkage converts the actuator actuating first direction and then in the second direction, into rotation of the drum, and a plurality of valve actuators configured to engage the plurality of camming surfaces. The drum rotating changes which of the plurality of valve actuators are engaged by the plurality of camming surfaces. The system further includes a plurality of valves coupled to the valve actuators, the valve actuators being configured to open or close the valves, and the valves controlling locking and unlocking of the spider and elevator controls.

A computer system for controlling a stand-building process is also disclosed. The system includes one or more processors, and a memory system comprising one or more non-transitory, computer-readable media storing instructions that, when executed by the processor, cause the system to perform operations. The operations include engaging a first tubular using an elevator, hoisting the first tubular by raising the elevator, lowering the first tubular into a spider by lowering the elevator, engaging the first tubular using the spider, disengaging the first tubular from the elevator after engaging the first tubular using the spider, engaging a second tubular using the elevator, hoisting and lowering the second tubular into engagement with the first tubular, connecting together the first and second tubulars, and disengaging the spider from the first tubular after connecting together the first and second tubulars. At all times during the stand-building process, the sequential step control system locks an open/close control of the elevator control, or locks an open/close control of the spider control, or locks both, depending on a step of the stand-building process being performed.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
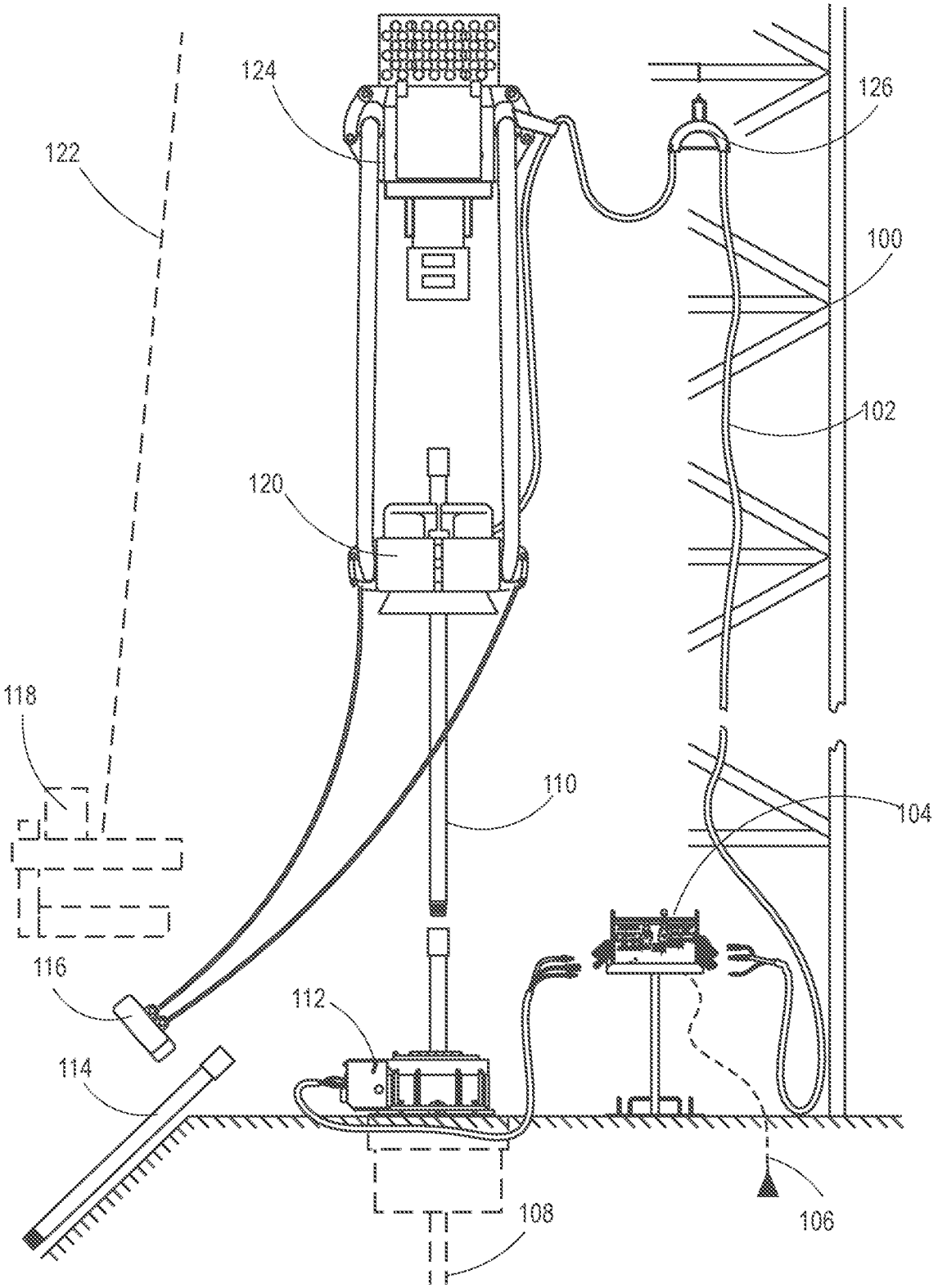
FIG. 1 (Prior Art)
FIG. 1 illustrates a side view of a conventional drilling rig.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Figure 3:
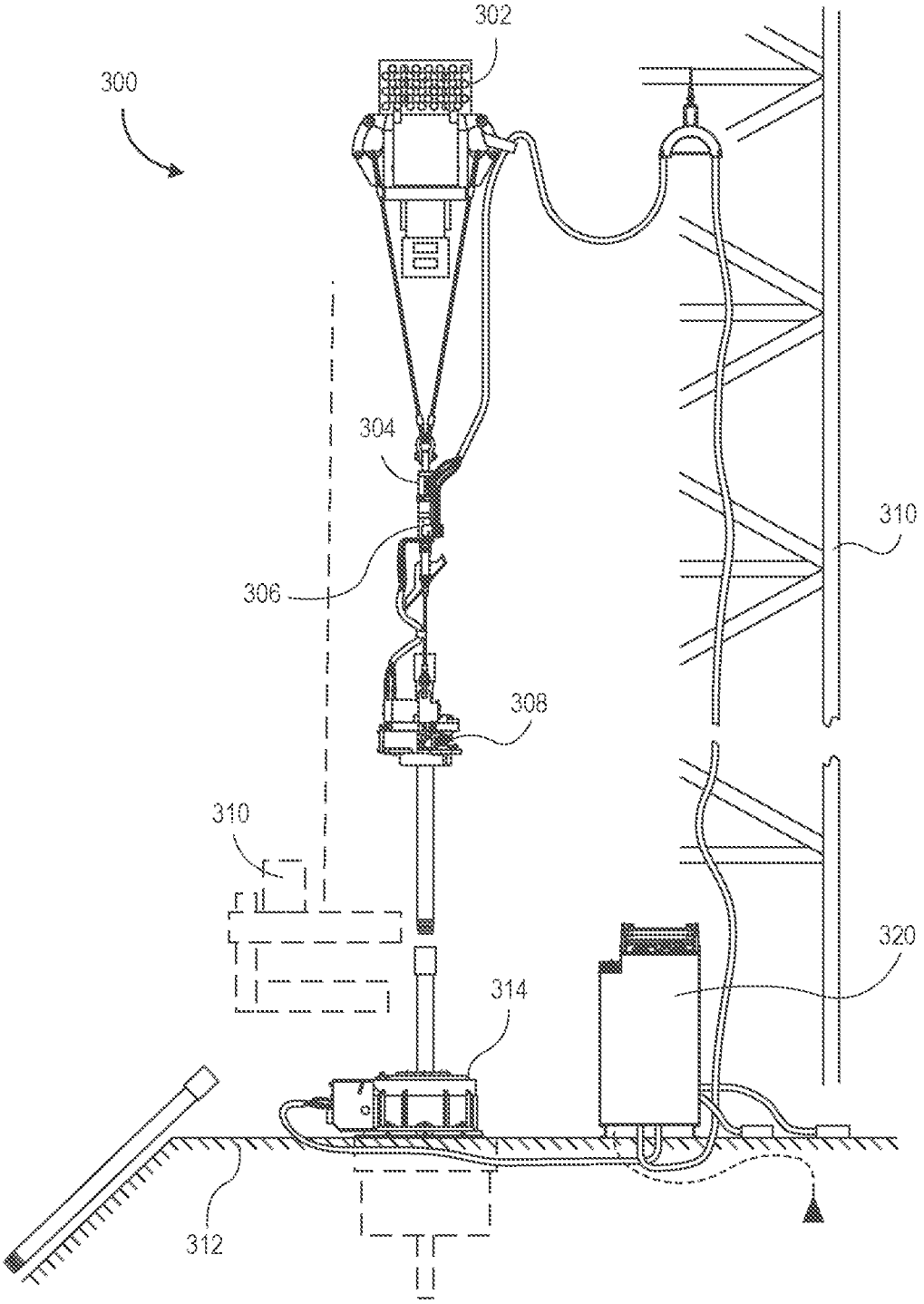
FIG. 3 illustrates a side view of a drilling rig including a sequential step control system, according to an embodiment.

FIG. 3 illustrates a side view of a drilling rig 300, according to an embodiment. The drilling rig 300 may include tubular running equipment, for example, a top drive 302 a hoist swivel 304, a pneumatic swivel 306, an auxiliary elevator 308, and a tong 310 (which may be hanging tong or an automated roughneck type tong). These components 302-310 may be supported on a derrick 311, and held therefrom above a rig floor. Further, the components 302-310 may be movable, at least vertically with respect thereto. It will be appreciated that the components 302-310 are not exclusive, and various other components may be employed therewith.

The drilling rig 300 may also include a spider 314, which may be located at and/or through/below the rig floor 312 and aligned with a mouse hole for building stands, or another borehole. The spider 314 may include slips or other gripping structures configured to hold a tubular or string of tubulars in the mouse hole. Operation of the drilling rig 300 may be similar to the stand-building operation discussed above, with the auxiliary elevator 308 (hereinafter, simply referred to as an "elevator") moving to grip/engage a joint 316, raise it above the spider 314, and lower it therethrough, whereupon the spider 314 may grip the joint 316 and the auxiliary elevator 308 may release.

In addition to the sequence discussed above, the drilling rig 300 may also include a sequential step control system 320, which may be configured to enforce rules for the safe operation of the spider 314 and the auxiliary elevator 308, e.g., to avoid the potential for dropped pipes discussed above. The word "system" should not be construed to require a mechanical (or even electromechanical) implementation, although some embodiments are implemented as mechanical devices, but allows for a software-implementation, as will be described in greater detail below.

Mechanical Sequential Step Control Systems

Figure 4:
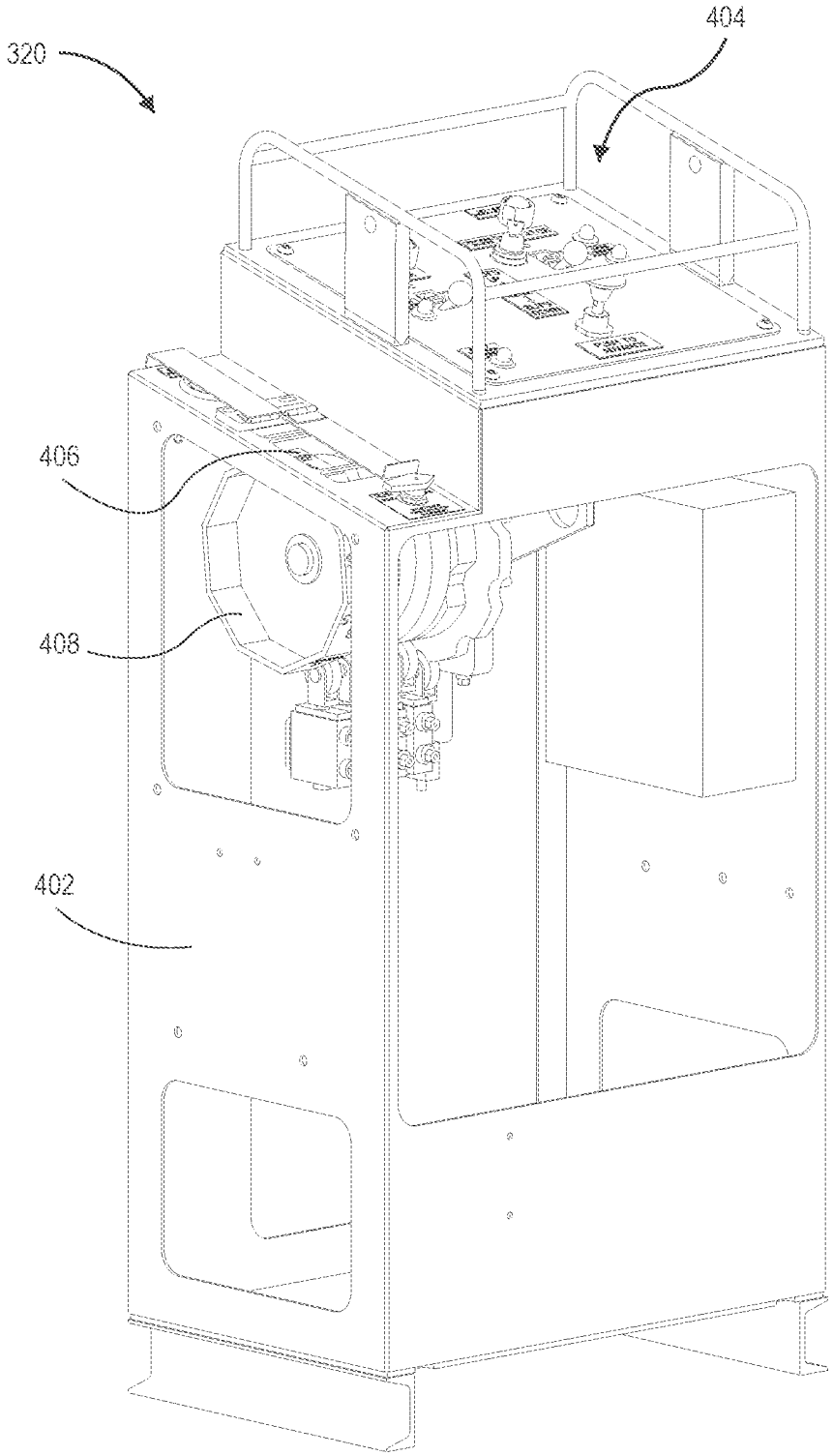
FIG. 4 illustrates a perspective view of the sequential step control system, according to an embodiment.

In an embodiment, the sequential step control system 320 may be a mechanical device, which may, for example, control pneumatic valves to enable or disable opening/closing of the elevator 308 and spider 314. FIG. 4 illustrates a perspective view of such a mechanical implementation of the sequential step control system 320, according to an embodiment. Externally, the stand-building control system 320 generally includes a cabinet 402, a control panel 404, and a step dial indicator 406. The current "step" in the stand-building process is displayed to the operator on the step dial indicator 406. As the steps are advanced, the step dial indicator 406 advances therewith, e.g., by rotation of a programming drum 408, as will be described in greater detail below.

Figure 5:
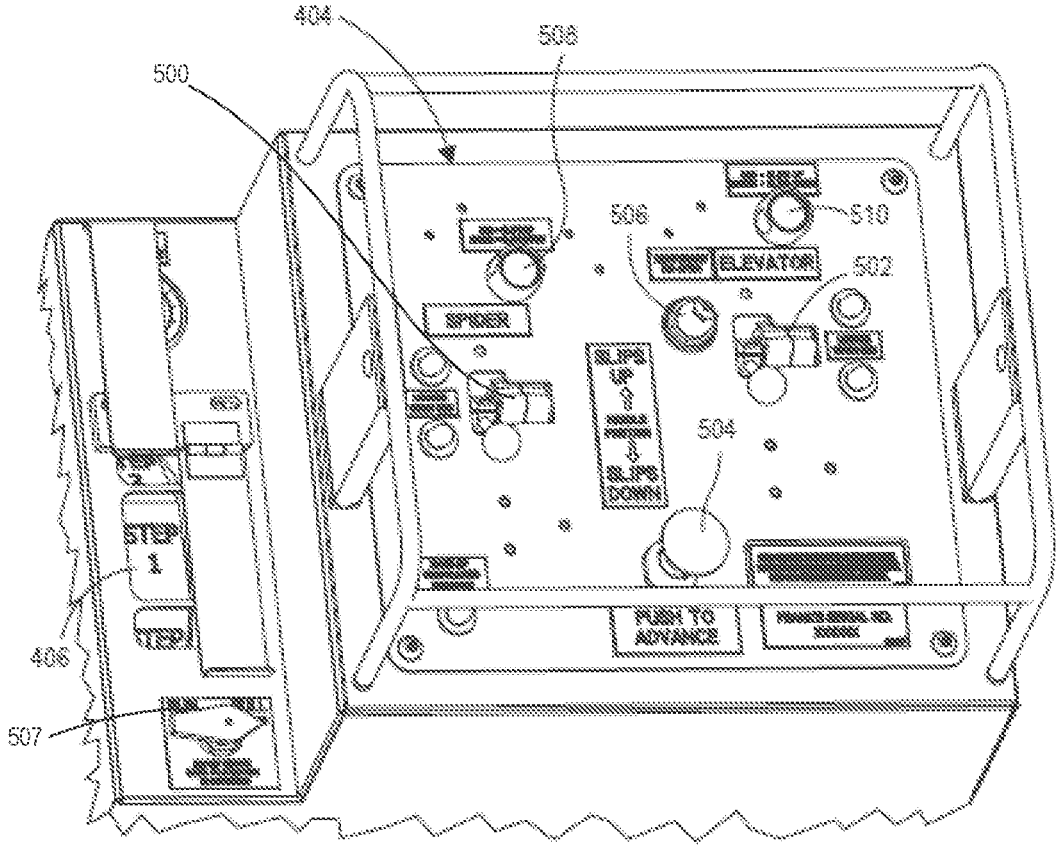
FIG. 5 illustrates a perspective view of a control panel of the sequential step control system, according to an embodiment.

FIG. 5 illustrates a perspective view of the control panel 404, according to an embodiment. As shown, the control panel 404 may generally include a spider control handle 500 (an example of an "open/close" control for the spider 314), an elevator control handle 502 (an example of an "open/close" control for the elevator 308), a step-advance button 504, and a control valve lock override 506. The control panel 404 may also include a ball valve 507, which may control whether the system 300 is configured for stand-building or stand-disassembly, as will be described in greater detail below.

The control panel 404 may also include a spider interlock indicator 508, which indicates that the spider 314 is gripped (or "closed") or released (or "open"). The control panel 404 further includes an elevator interlock indicator 510, and lock indicators for grip and release of both the spider 314 and the elevator 308. Various other indicators may be provided to provide visual feedback to a user as to the status of the drilling rig 300 components.

In an embodiment, the spider control handle 500, when unlocked, may be moved upward to open the spider 314 (e.g., raise the slips thereof), and downward to close the spider 314 (e.g., lower the slips thereof). Likewise, the elevator control handle 502 may be moved up and down to control the opening and closing of the elevator 308. These controls may be rendered inoperative ("locked") by the system 320 to enforce a proper sequence of a stand-building or disassembly process, as will be discussed below. The step-advance button 504 may be depressed in order to send a step-advance command signal to the system 320. In an embodiment, the step-advance button 504 may be depressed by the user after a reset command has been received, but may be inoperative before the resent command is received. A reset command is received when the conditions related to completing the programmed step are completed (i.e., shifting the spider to close and receiving interlock feedback confirmation that the spider closed successfully), then a reset signal may be supplied to the advance button so that it can be pushed again to proceed to the next step. Thus, for advancement to the next step, the system 320 receives a feedback signal, indicating that the current step is complete, and a step-advance command, and this two-part "cycle" results in the advancement of the drum 408, as will be described in greater detail below.

Figure 6A:
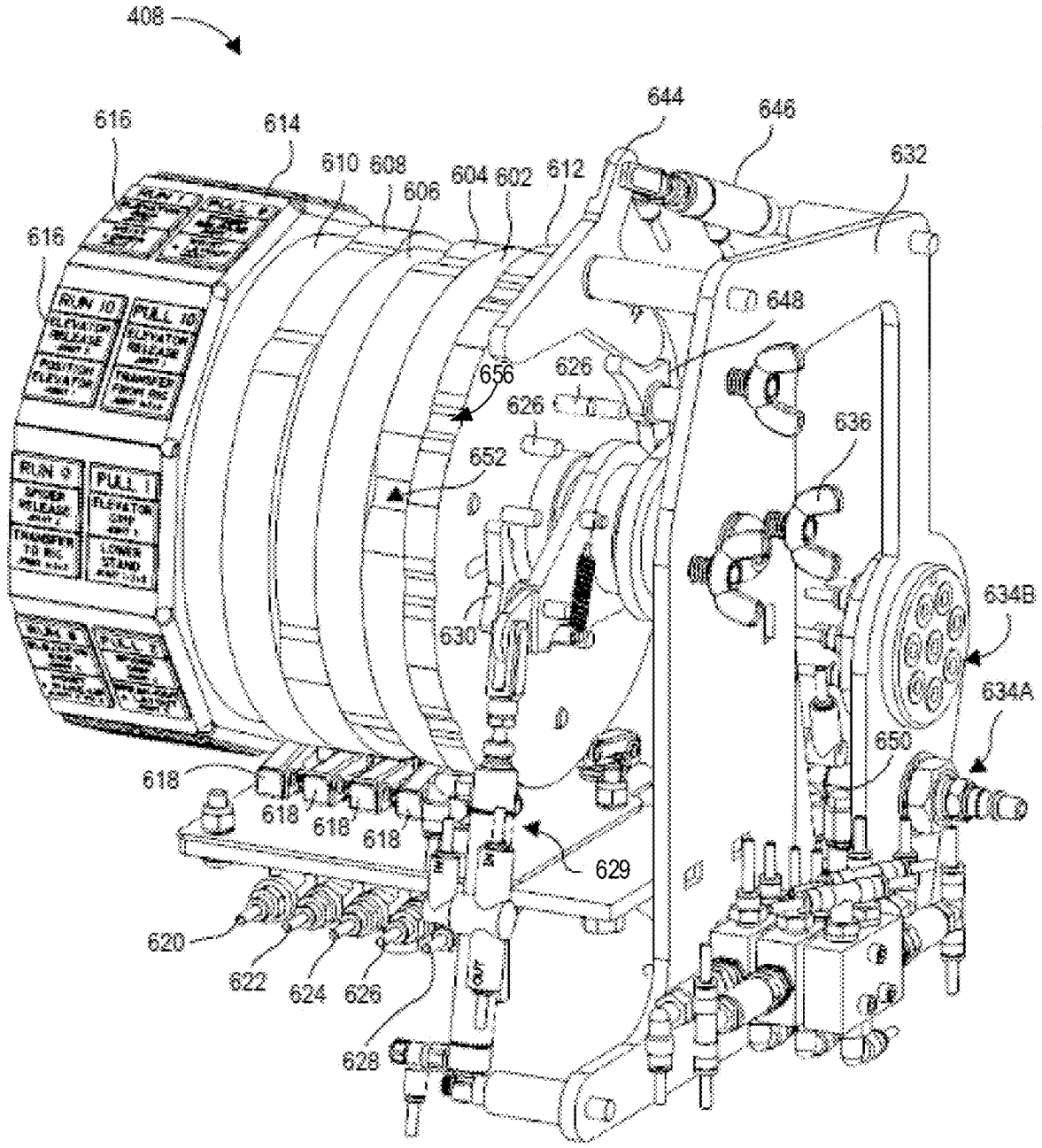
FIG. 6A illustrates a perspective view of a programming drum of the sequential step control system, according to an embodiment.

FIG. 6A illustrates a more-detailed, perspective view of the drum 408, according to an embodiment. The drum 408 shown is for building (or breaking down) "triples" made from three joints, and provides for one indexed rotation step for each discrete step of the process, thereby enforcing the proper sequence and avoiding a potential for dropping tubulars. In an example, the number of steps for building a triple, as shown, is ten, and thus the drum 408 may include ten indexed positions, with the appropriate labels visible through system window 406 at each respective step (FIGS. 4 and 5). In other applications, any other number of steps may be used.

In this embodiment, the drum 408 provides programming logic that controls the system 320, providing a mechanical sequential control. The drum 408 includes an indexing plate 612, a label ring 614, step indicator labels 616, and several cam rings (five are shown: 602, 604, 606, 608, 610), at least some of which may include camming surfaces along their periphery that engage valve actuators. For example, the cam rings 602-610 may each include camming grooves 652 while the indexing plate 612 may include indexing grooves 656. The indexing plate 612, label ring 614, and cam rings 602-610 may be separate rings that are attached together, face-to-face, or may be formed integrally from a single, monolithic drum. The components of the drum 408 may be supported by a frame 632 connected thereto.

Further, cam-followers 618 serve as valve actuators in this embodiment, controlling the actuation of valves 620, 622, 624, 626, and 628 in response to the geometry of the camming surfaces of the rings 602-610. The actuation of valves 620-628, e.g., in combination with other logic valve elements, may control pneumatic or hydraulic power fed to the elevator 308 (FIG. 3) and/or the spider 314 (FIG. 3), so as to allow or disallow actuation of the elevator 308 and/or spider 314 by unlocking and locking the control handles 500 and 502 (FIG. 5). For example, the cam followers 618 may follow the periphery of the cam rings 602-610 and the indexing plate 612, respectively, and actuate the valves in response to engaging one of the camming grooves 652. Thus, the placement of the camming grooves 652 may control the logic applied by the system 320, at least in a mechanical embodiment.

The drum 408 may also include pins 626 located at angular intervals around the center of the index disk 612. The drum 408 may include a pneumatic "run" actuator 629, which may be coupled to a spring-loaded pawl 630. The actuator 629 may be coupled to the drum 408, such that the actuator 629 is configured to rotate the drum 408 about a central axis. In particular, the actuator 629 may be configured to respond to a feedback signal so as to actuate in a (e.g., "first") direction, and to respond to a step-advance command so as to actuate in a (e.g., "second") direction. Nothing should be inferred as to an order in which the drum 408 advances form the terms "first" and "second" directions, as these names are only meant to distinguish the two directions.

A linkage may couple the actuator 628 to the drum 408, such that the linkage converts the actuator 629 actuating in first direction and in the second direction, into rotation of the drum 408. For example, when the step-advance button 504 (FIG. 5) is depressed, the actuator 629 may retract, thereby allowing the pawl 630 to advance into engagement with one of the pins 626 and thereby turn the drum 408, e.g., turn the index disk 612 (and thus other disks 602, 604, 606, 608, 610, and 614) relative to the drum module frame 632 and the valves 620-628.

As an example, the "triple" (referring to a stand with three joints) drum module 408 shown provides discrete steps required to build or break down three joints that make up a stand, and the module can be swapped out of the system 320 with another programmed module with more or less discrete steps to build up or break down stands made up of more or less joints. Quick disconnects 634A, 634B and the thumbscrews 636 may be provided to facilitate such replacement, so that the system 320 can be configured to handle different stands within minutes.

Via the respective followers 618 engaging the valves 620-628, the cam ring 602 may control the elevator controller 502, the cam ring 604 may control the spider controller 500, the cam ring 606 may be an interlock-off cam ring, the cam ring 608 may pause the drum 408 until a feedback signal to indicate a successful make-up by the tong (e.g., based on a feedback signal indicated from a user, such as via a foot pedal), and the cam ring 610 may be a cam-less spare for additional feedback expansion.

Figure 2B:
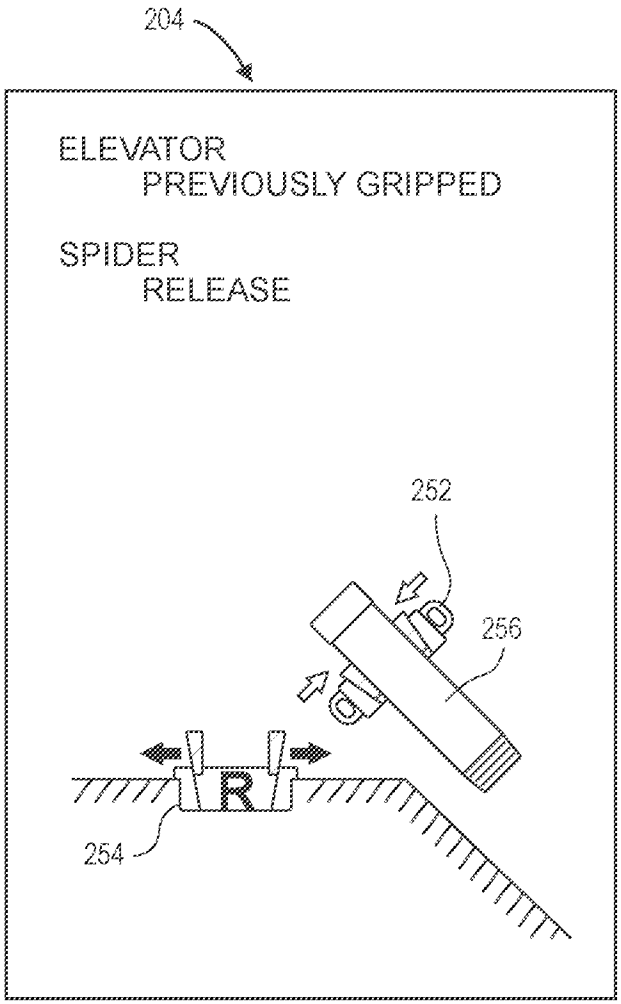
FIG. 2B (Prior Art)
FIGS. 2A-2P illustrates a conventional operational sequence for building stands using the conventional drilling rig.
Figure 2A:
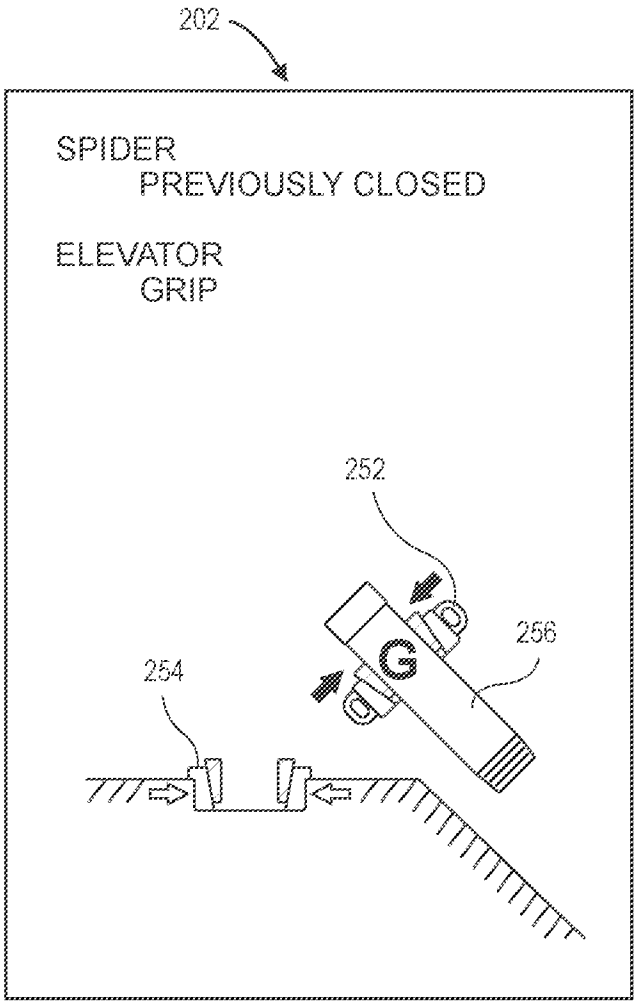
FIG. 2A (Prior Art)
Figure 2D:
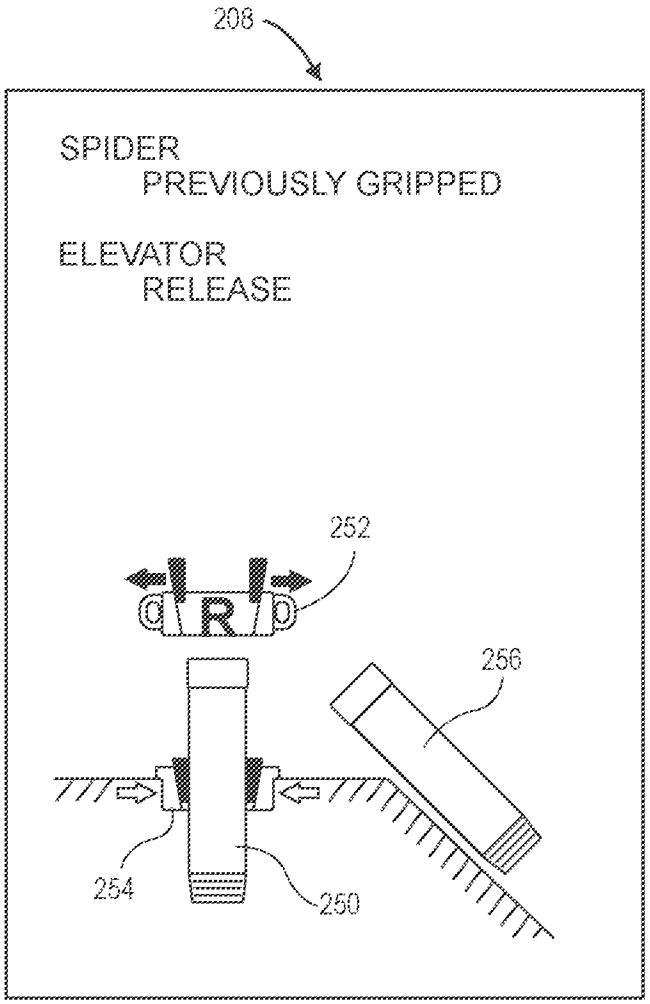
FIG. 2D (Prior Art)
Figure 2C:
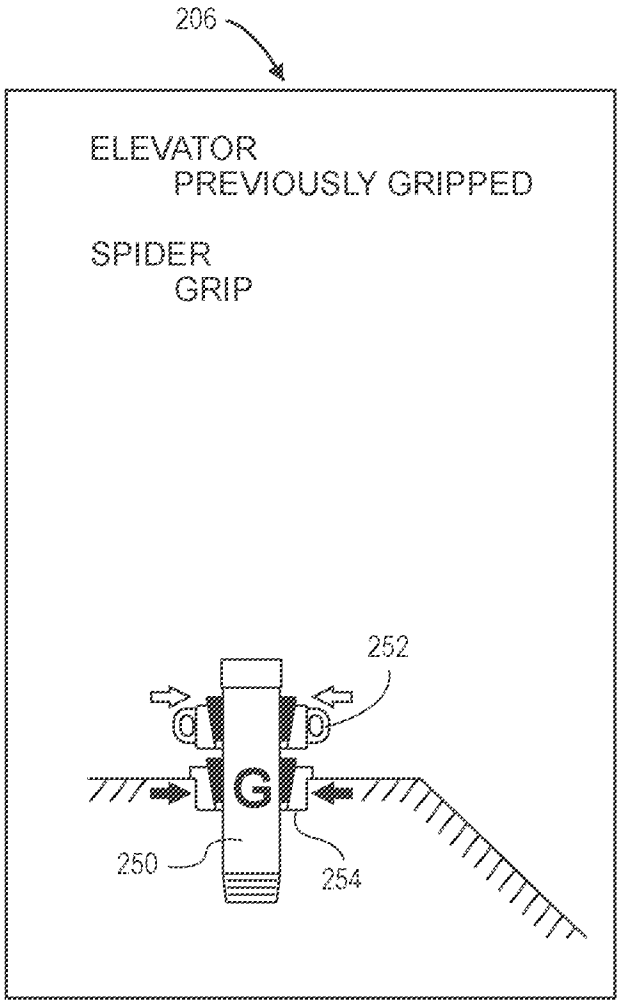
FIG. 2C (Prior Art)
Figure 2E:
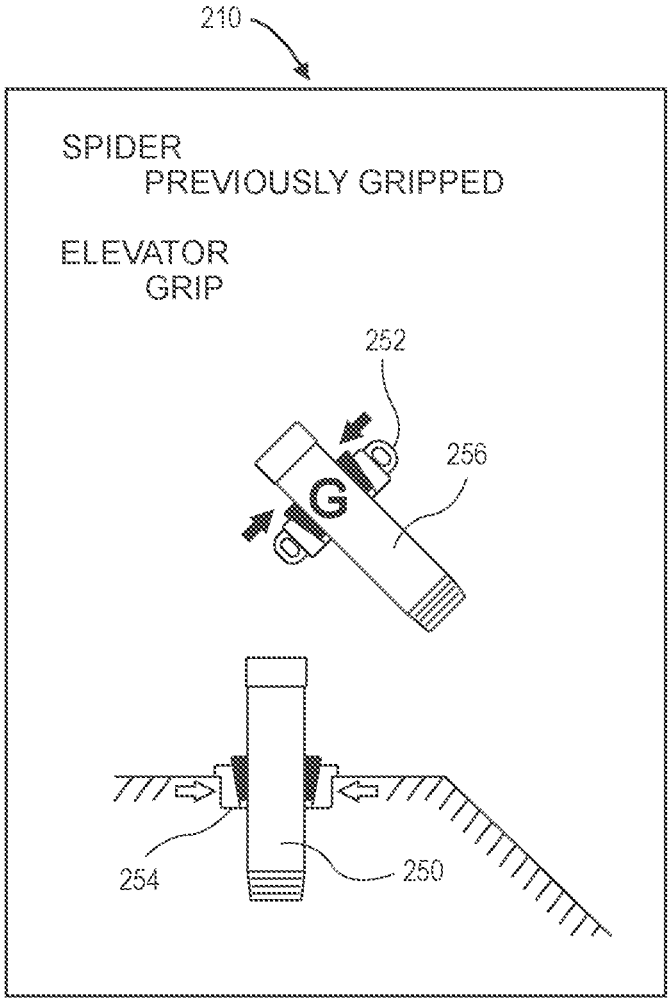
FIG. 2E (Prior Art)
Figure 2F:
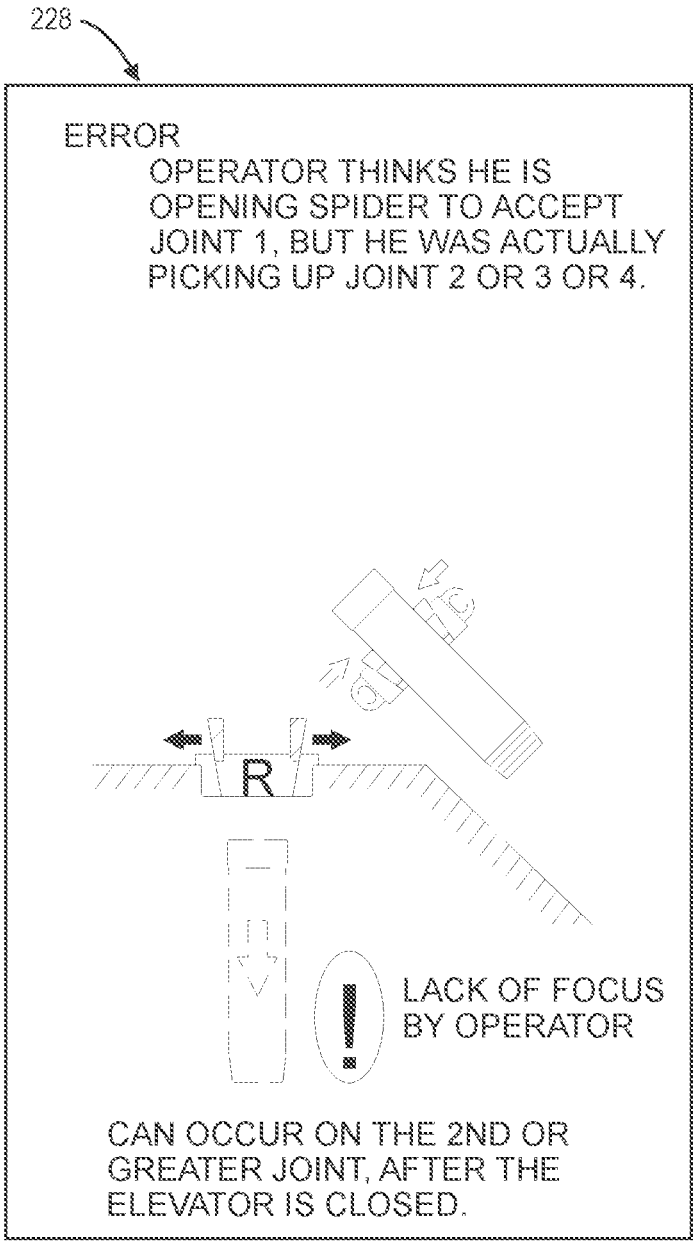
FIG. 2F (Prior Art)
Figure 2G:
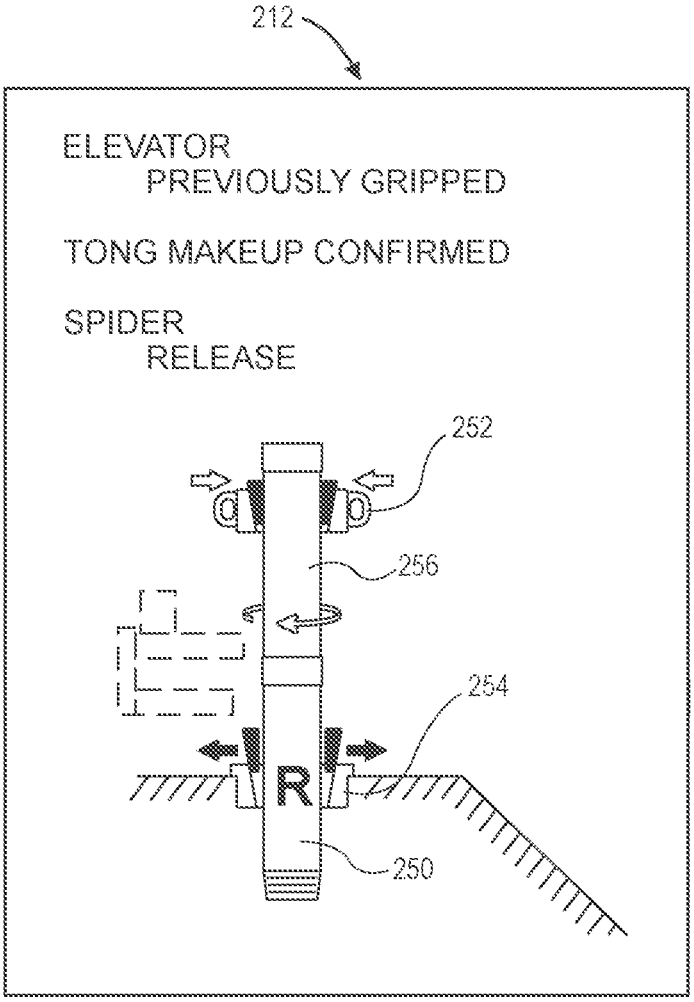
FIG. 2G (Prior Art)
Figure 2I:
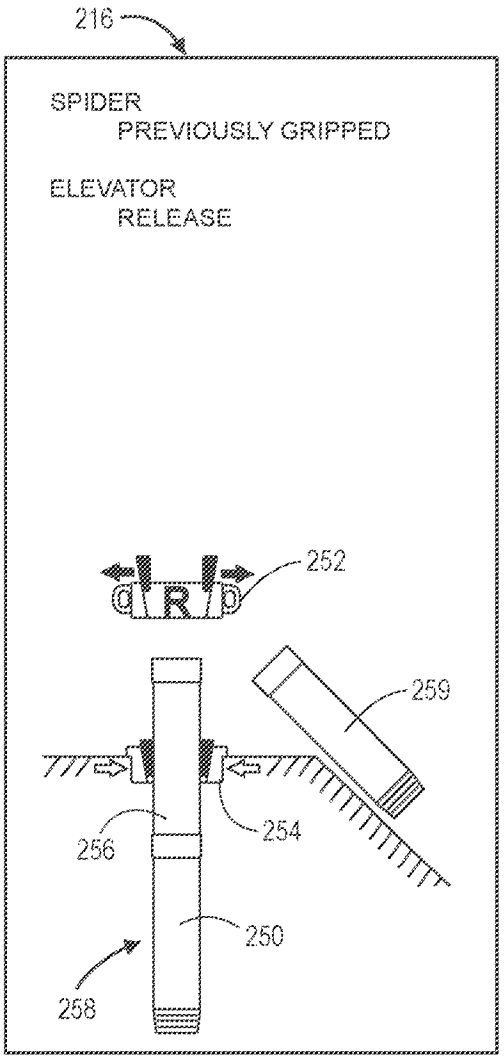
FIG. 2I (Prior Art)
Figure 2H:
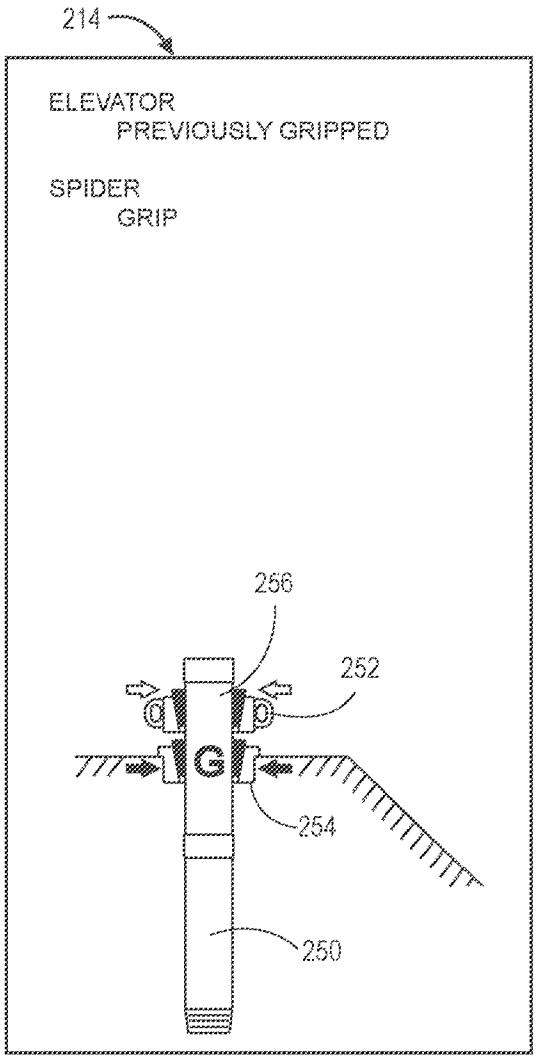
FIG. 2H (Prior Art)
Figure 2K:
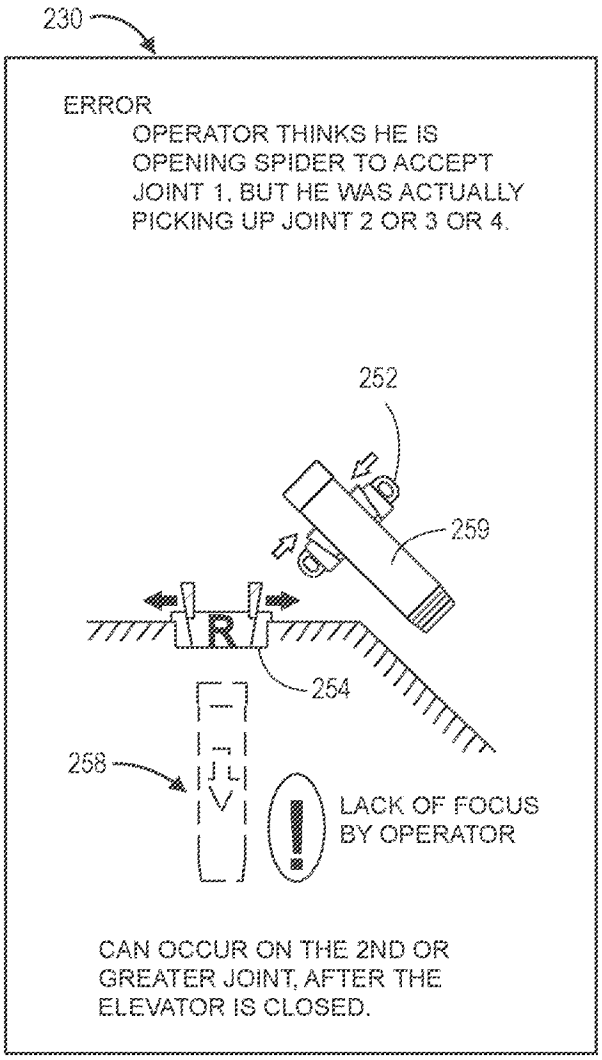
FIG. 2K (Prior Art)
Figure 2J:
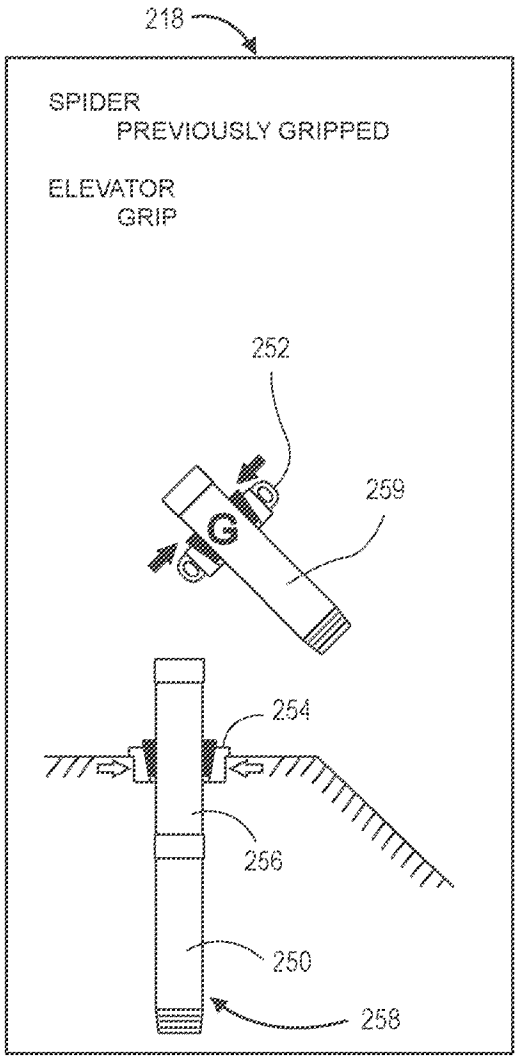
FIG. 2J (Prior Art)
Figure 2M:
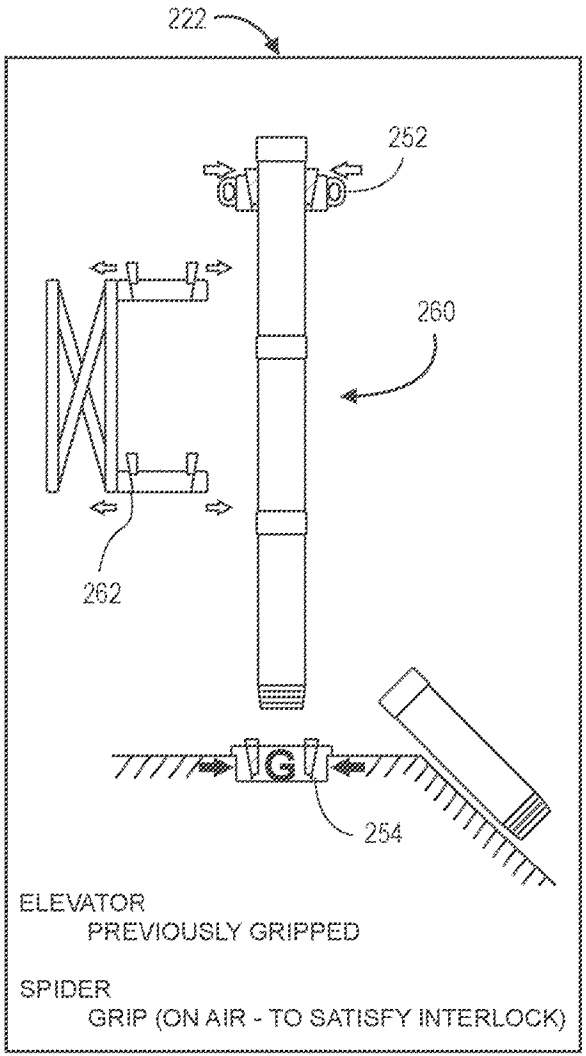
FIG. 2M (Prior Art)
Figure 2L:
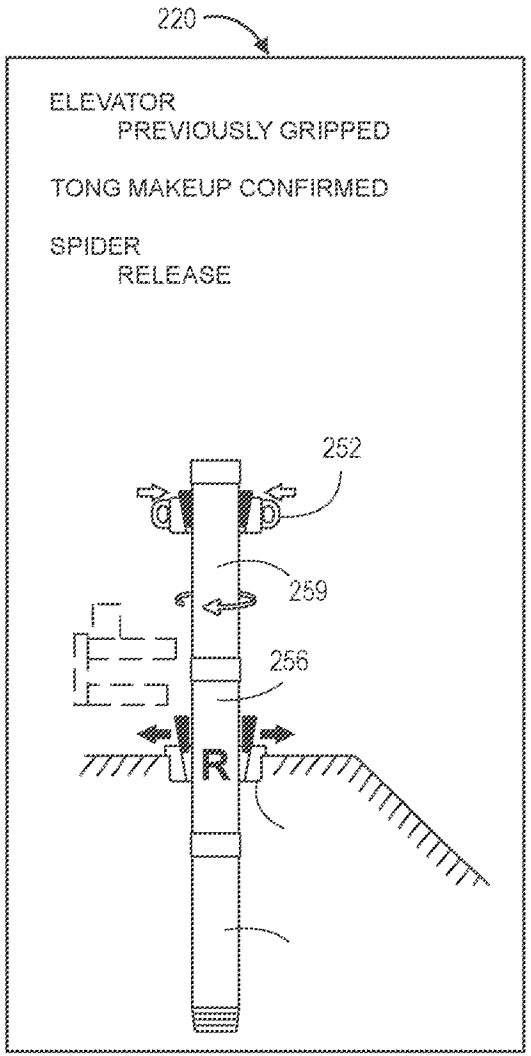
FIG. 2L (Prior Art)
Figure 2O:
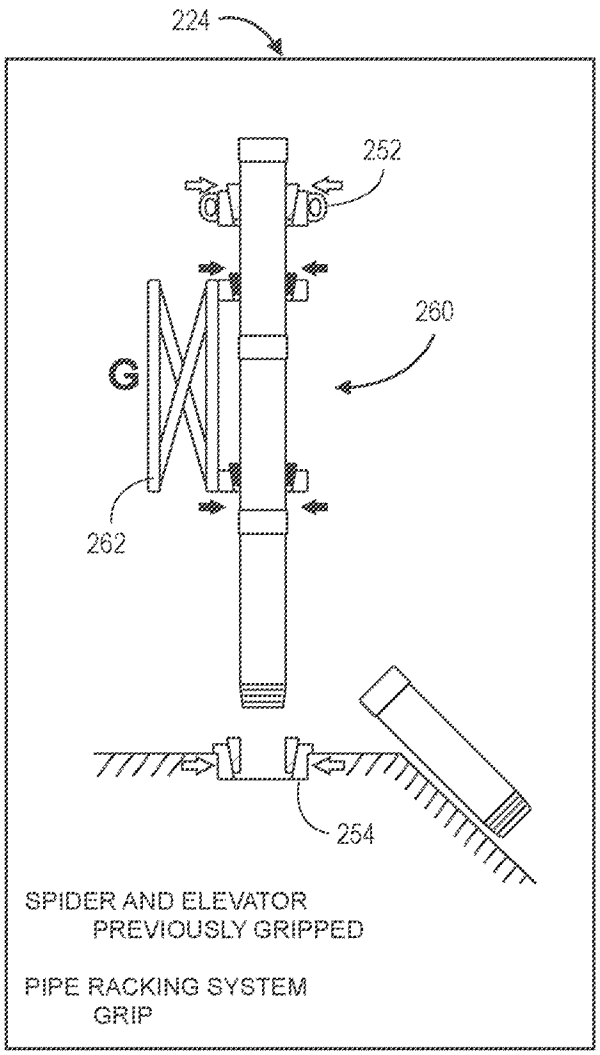
FIG. 2O (Prior Art)
Figure 2N:
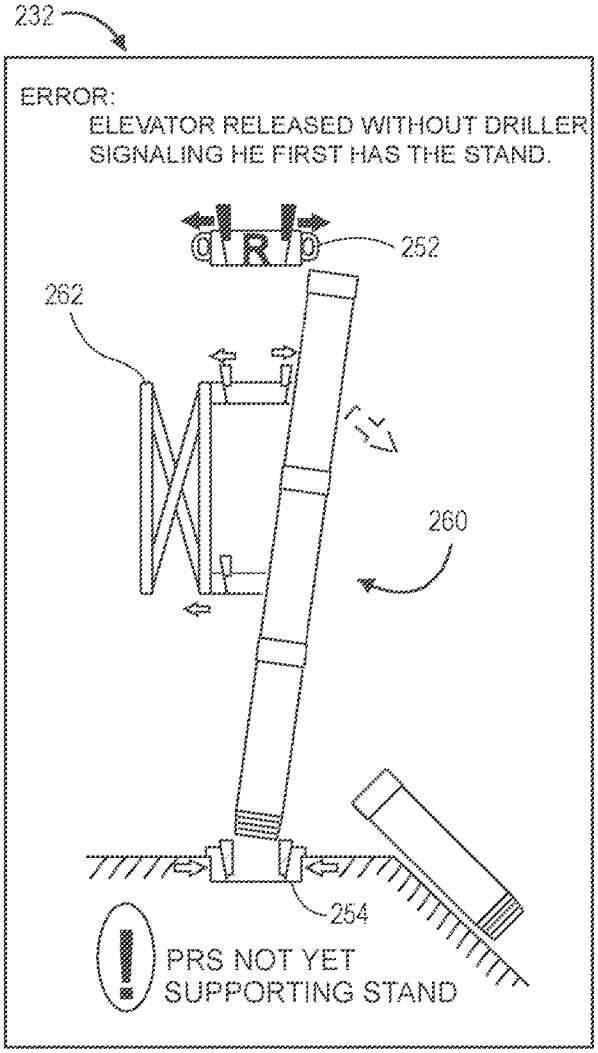
FIG. 2N (Prior Art)
Figure 2P:
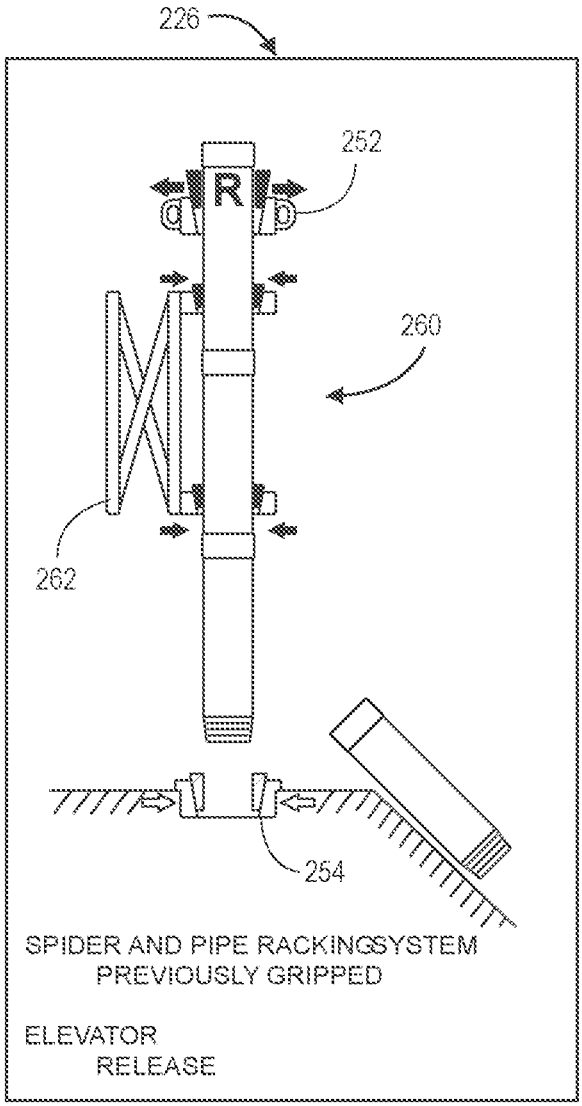
FIG. 2P (Prior Art)

Still referring to FIG. 6A, additional reference is again made to FIGS. 2A-2P, and a description is provided for one potential implementation of the rig 300 including the system 320 operated by rotating the drum 408. For example, the cam ring 606 may create a logic signal that allows both the spider control 500 and the elevator control 502 to open the spider 314 and elevator 308, respectively (bypassing the interlock), when the follower 618 associated therewith engages the camming groove 652 thereof. The actuator 629 may be extended and prepared to engage the index disk 612. When the operator presses the step-advance button 504, the actuator 629 is retracted, which causes the drum 408 to rotate one incremental step, such that the elevator control 502 is unlocked, which allows the elevator handle 502 to be shifted closed while the spider control handle 500 remains locked in the released position. After the user grips the first joint using the elevator, the feedback signal from the elevator extends the pneumatic actuator 629, which prepares the pawl 630 to engage one of the pins 626 on the index disk 612 for the next step in the sequence. The step-advance 504 button is automatically reset, the elevator control 502 is locked and the spider control remains locked, as a result of this same action.

A similar step transition (or "cycle") may occur each time a step is complete and the step-advance button 504 is depressed. Generally, after the system 320 receives the feedback signal, the step-advance button 504 being depressed causes the pneumatic actuator 629 to retract. As a consequence, the camming surfaces engage the valve actuators in one of several different possible combinations, resulting in the appropriate logic valve actuation to allow one of the controls 500, 502 to be unlocked. Feedback representing that the step is complete causes the pneumatic actuator 629 to extend, thereby preparing the pawl 630 to advance the drum 408 upon the next step-advance button 504 depression.

Logic valve circuitry elsewhere in the system causes the controls 500, 502 to lock/remain locked. As such, at each step, only the correct one of the elevator and spider controls 500, 502 are unlocked, and they are again locked once their function in the step is complete, thereby preventing the aforementioned uncontrolled release of tubulars therefrom.

The system 320 may also break down stands into the individual joints. The cam disk 602-610 when run in reverse rotation allows this activity, so the system 320 may be equipped with components to facilitate this. The ball valve 507 switches between the two modes called "Run Mode" and "Pull Mode" for assembling or disassembling a stand, respectively. When Run Mode is selected on valve 507, the actuator 629 and pawl 630 engage the drum 408 to rotate in the Run direction, a mode actuator 646 is retracted, and a mode toggle plate 644 disengages pull-pawl 648 from the index pins 626, the logic circuitry extends the pull-actuator 650, and the left-side labels 406 are referenced by the human operator. When Pull Mode is selected on valve 507, the mode actuator 646 is extended, and mode toggle plate 644 rotates and disengages the run-pawl 630 from the index pins 626, the logic circuitry extends the run-actuator 629, resulting in reverse rotation of the drum, and the right-side labels 406 are referenced by the human operator. If there is a need to only temporarily back-up the sequence (i.e., to release a recently closed elevator so that it can be re-gripped on the tubular), a control valve lock override 506 may be rotated clockwise to open the elevator 308, locking out the other system 320 functions until the override 506 is rotated counterclockwise and the elevator 308 is re-closed.

Figure 6B:
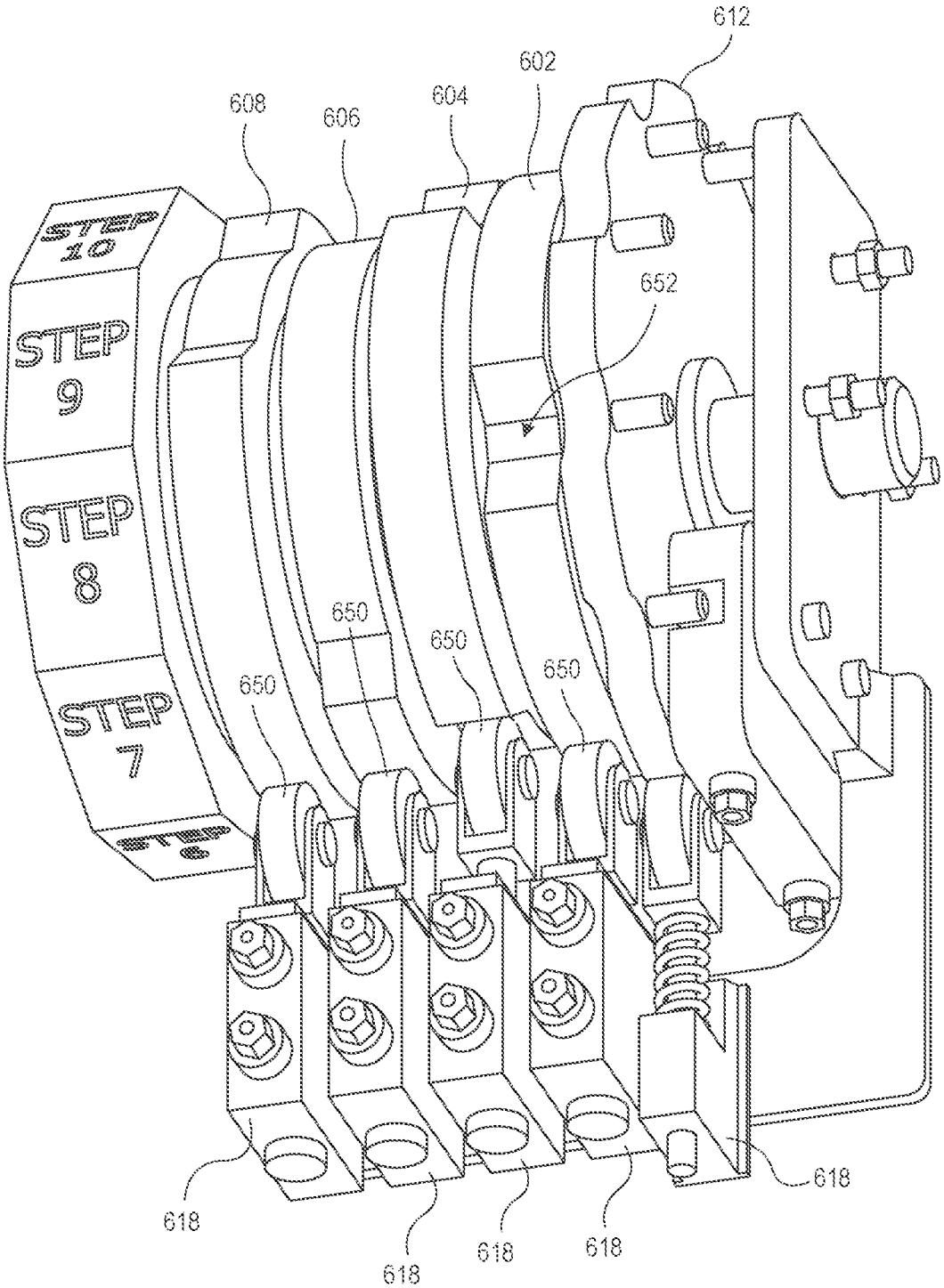
FIG. 6B illustrates a perspective view of a simplified embodiment of the programming drum.

FIG. 6B illustrates a perspective view of the drum 408 according to a simplified embodiment. The drum 408 of FIG. 6B may be similar to the drum of FIG. 6A, except that the cam followers 618 may include rollers 650. Thus, for example, each of the cam rings 602-610 may include camming grooves (or protrusions in other embodiments) 652. As the cam rings 602-610 rotate, the rollers 650 may roll along the respective cam disks 602-610. When the rollers 650 encounter a camming groove 652, the cam followers 618 are pushed radially inwards, thereby actuating the valve 620-624 or actuator 629 associated therewith.

Although the mechanical embodiments discussed herein focus on the use of a rotating drum with camming surface, this is but one example of an implementation consistent with the present disclosure. Other hardware options to position a plurality of camming surfaces may include rotating disks or linear rods, etc.

Method for Controlling Stand Building Using the Sequential Step Control System With reference to the general drilling rig 300 discussed above and shown in FIG. 3, an embodiment of a method for controlling the stand-building procedure is now described. To assist in understanding the method, FIGS. 7-16 illustrate a sequence of operation, both as it would be apparent to an operator of the sequential step control system 320 (according to the above-described mechanical embodiment), as well as the effect given to the drilling rig 300 (e.g., the "tool action").

The method may begin by opening both the elevator 308 and the spider 314. This may be a default starting position, and the close controls for both the elevator 308 and the spider 314 may be inoperative ("locked") at this point. Moreover, at this point, neither the elevator 308 nor the spider 314 are positioned around a tubular. Before continuing, it is noted that, as used herein, "opening" the tubular gripping components refers to causing the tubular gripping components to actuate (or remain) in a non-gripping position, e.g., with slips raised and configured not to grip a tubular. Conversely, "closing" such tubular gripping components refers to causing the components to actuate (or remain) in a gripping position, e.g., with slips lowered and configured to grip a tubular. The components may also include sensors (e.g., load cells or position sensors) that may provide feedback indicating that the tubular gripping components are gripping a tubular or, despite being closed, not gripping a tubular (such as when they are not positioned around a tubular). The absence of a feedback signal when the gripping components are commanded to release the tubular may be interpreted as the tool being open. Embodiments of the systems herein may employ such feedback signals and perform actions in response thereto, as will be described below.

Figure 7:
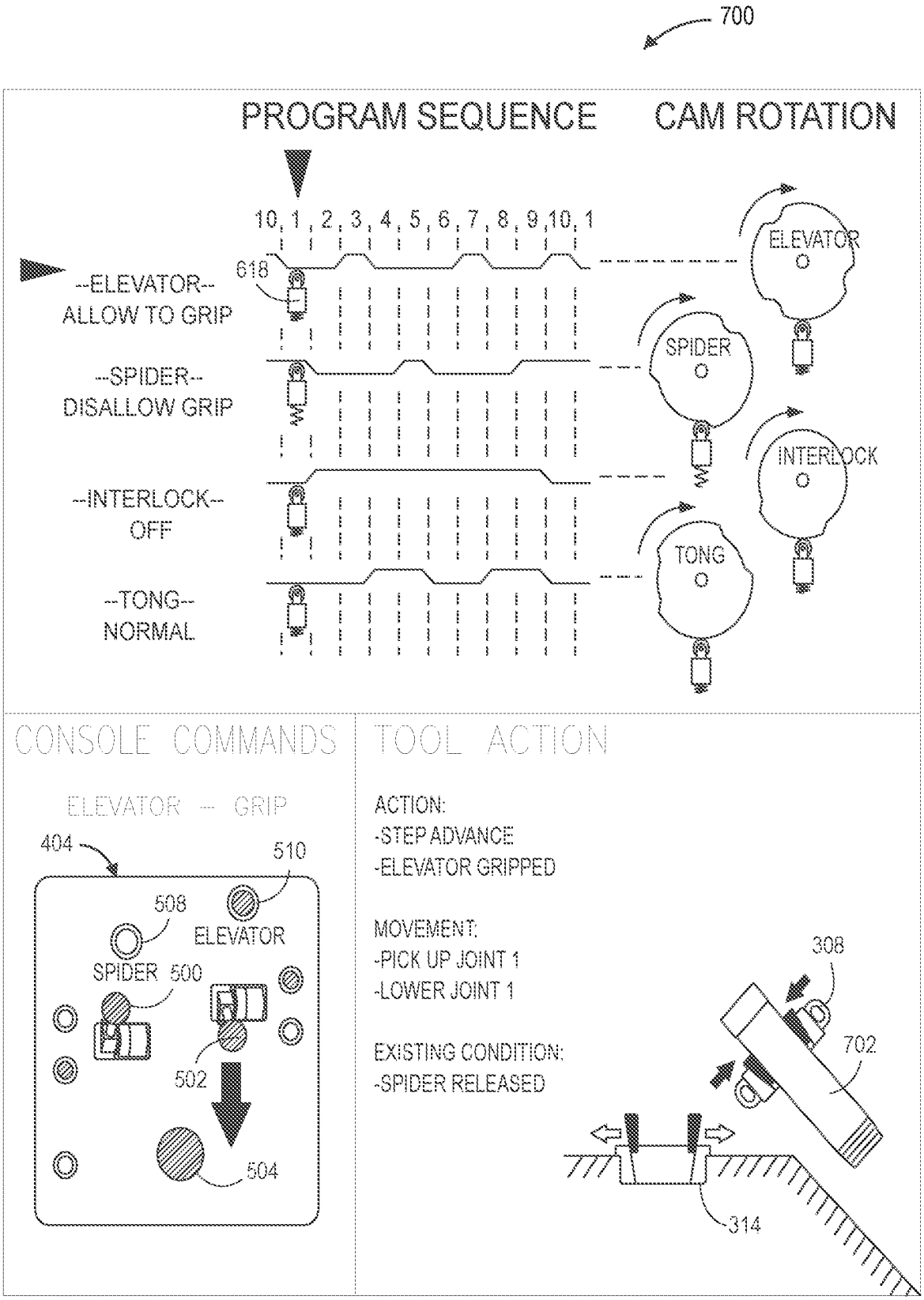
FIGS. 7-16 illustrate a sequence of operations for stand-building using the drilling rig and a mechanical embodiment of the sequential step control system, according to an embodiment.

As shown in FIG. 7, with the spider 314 and elevator 308 open, the method may proceed to positioning the elevator on a first tubular joint 702, which may be in a non-vertical position. The system requires both the control handles 500, 502 to be in the open position at the beginning of a sequence before the system will accept a command to advance step.

When an operator confirms that the elevator 308 is in position, the operator may enter a command to advance step, which may be received by the system 320. In response to receiving the command, the method may lock the spider control 500 and unlock the elevator control 502. As shown in process sequence 700 of FIG. 7, the drum 408 may rotate such that the elevator 308 is allowed to grip, the spider 314 is disallowed from gripping, the interlock is off, and the tong is normal.

In the present disclosure, "locking" a control means to render the control inoperative, such that the component being controlled cannot be actuated by that control. Such locking can be accomplished with pneumatic or hydraulic fluids or electrical signals or mechanically-implemented, e.g., to physically prevent a lever from moving, or software from advancing. Moreover, such locking of the controls can occur when the components are in either the open or closed position. Conversely, an unlocked control is operative to close or open the associated tool. "Locking" and "unlocking", however, should not be interpreted to mean that a state change necessarily occurs, e.g., a locked controller that is described herein as being locked simply remains locked.

Figure 8:
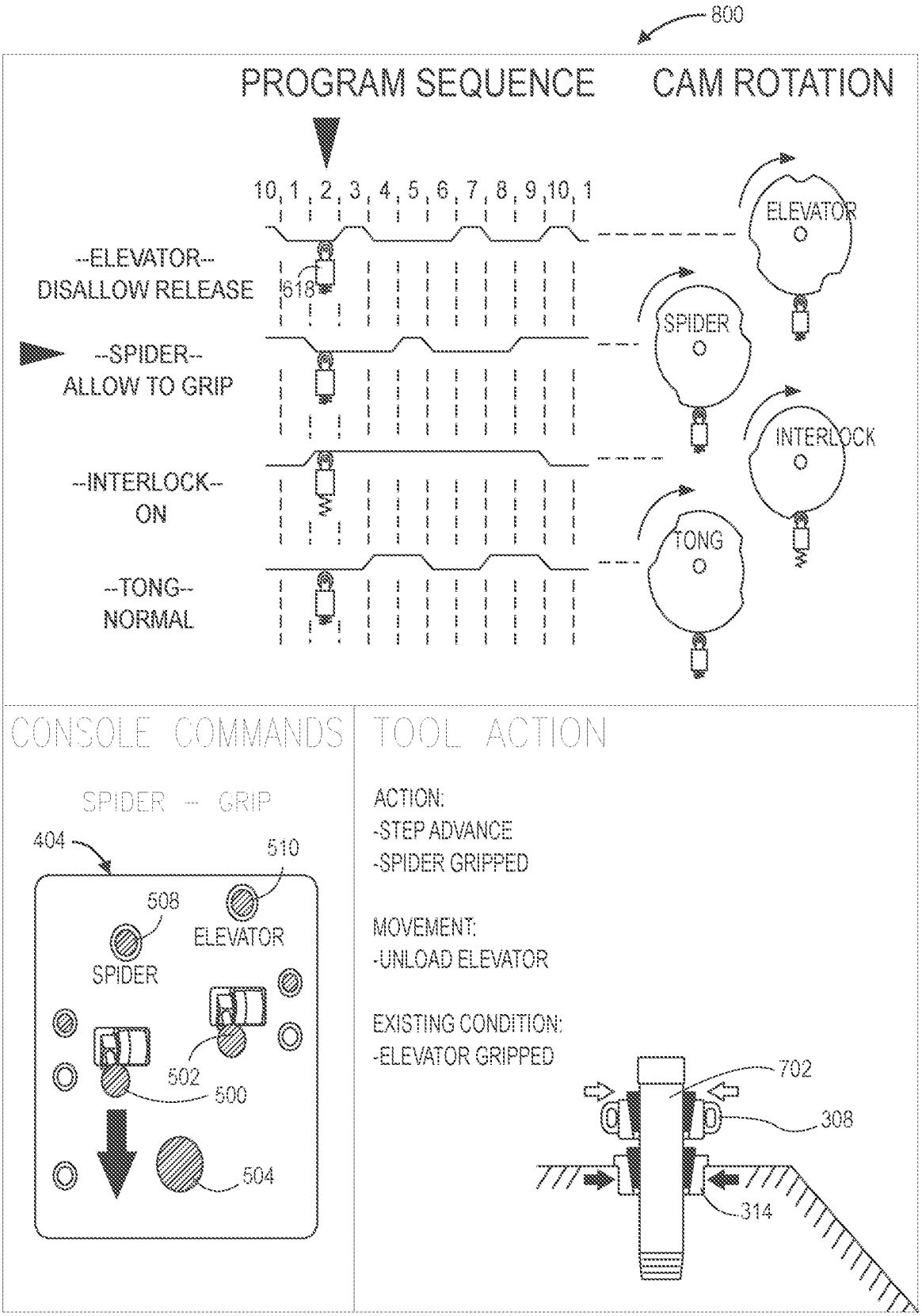

With the elevator 308 in position around the first tubular joint 702, and the elevator control 502 unlocked, the method may proceed to gripping the first joint using the elevator, by operation of the elevator control (e.g., operated by a human operator). Once the elevator 308 grips the tubular joint 702, the elevator control 502 may be locked. Further, the system 320 may receive a feedback signal automatically (or a feedback signal may be entered by a human user in response to, e.g., visual inspection that the slips are set) indicating that the elevator 308 is gripping the first joint 702. As shown in FIG. 8, the method may then include hoisting the first joint 702 from the non-vertical position to a vertical position above the spider 314, and lowering the first joint through the open spider and into the mouse hole.

Once the elevator 308 has lowered the first joint 702 through the spider 314, such that the elevator 308 is directly above the spider 314, a step-advance command may be received (e.g., as entered by a user). This moves the program sequence to index 2, as indicated at 800. In response, the method may include unlocking the spider control 500. A user, for example, may then enter a command into the system 320 for the system 320 to cause the spider 314 to grip the first joint 702. This enables the weight of the first joint 702 to be transferred from the elevator 308 to the spider 314. The method also includes locking the spider control 500. A feedback signal may be provided back to the system 320, indicating that the spider 314 has successfully gripped the first joint 702.

Figure 9:
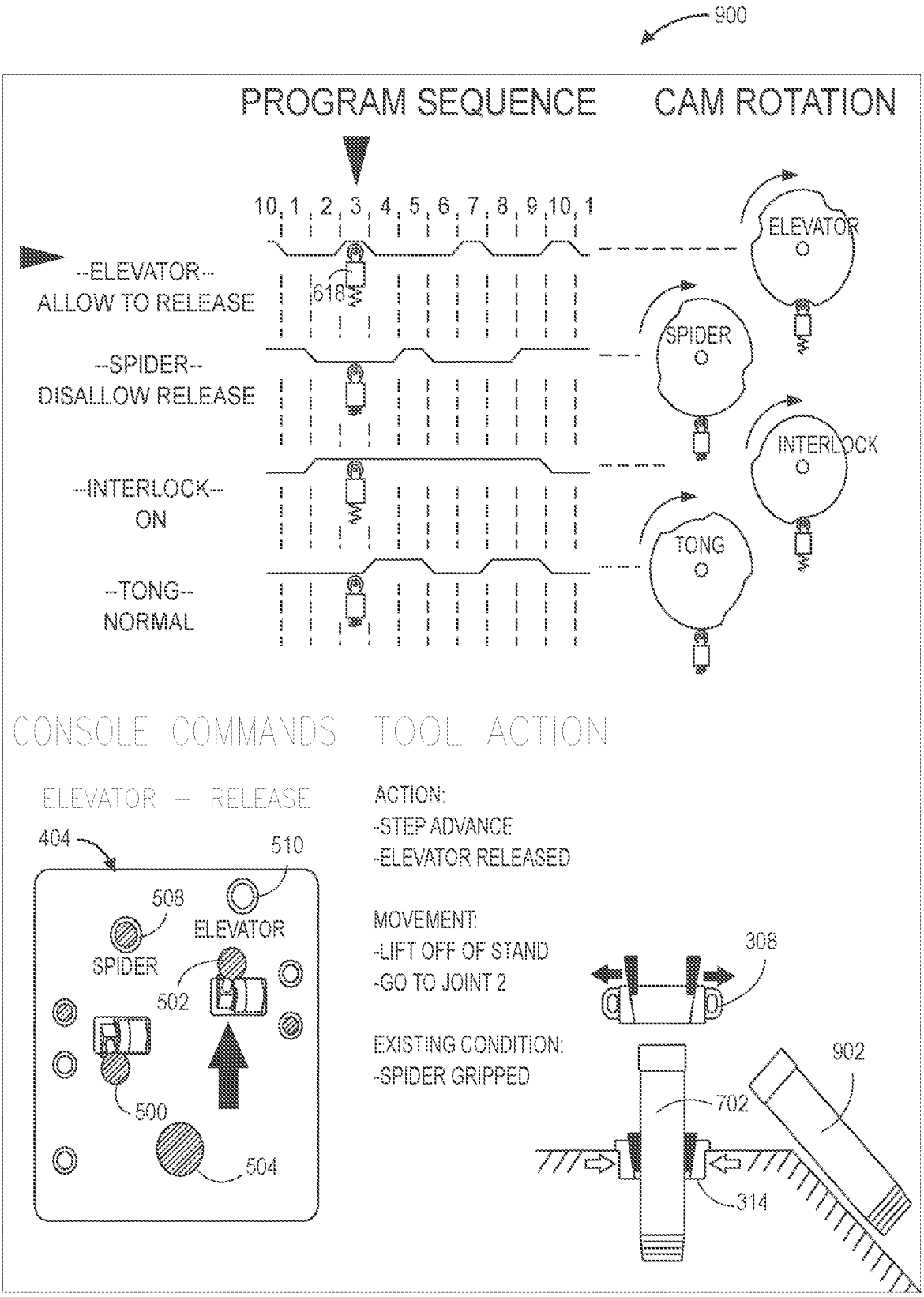

With the weight transferred, the system 320 may receive another command to advance step (e.g., entered by a user). In response, the system 320 (e.g., the drum 408 thereof) may advance to index 3, as shown in FIG. 9 at 900. As such, the system 320 may unlock the elevator control 502. The user may then enter a command to open the elevator 308 (by moving the elevator control 502), which the system 320 may cause the drilling rig 300 to implement, by releasing the elevator 308 from the first joint 702. The method may then include locking the elevator control 502. A feedback signal from the elevator 308 may indicate that the elevator 308 has released the first joint 702.

With the elevator 308 now open and released from the first joint 702, the method may proceed to removing the elevator 308 from the first joint 702 and placing the elevator on a second joint 902 that is in the non-vertical position.

Figure 10:
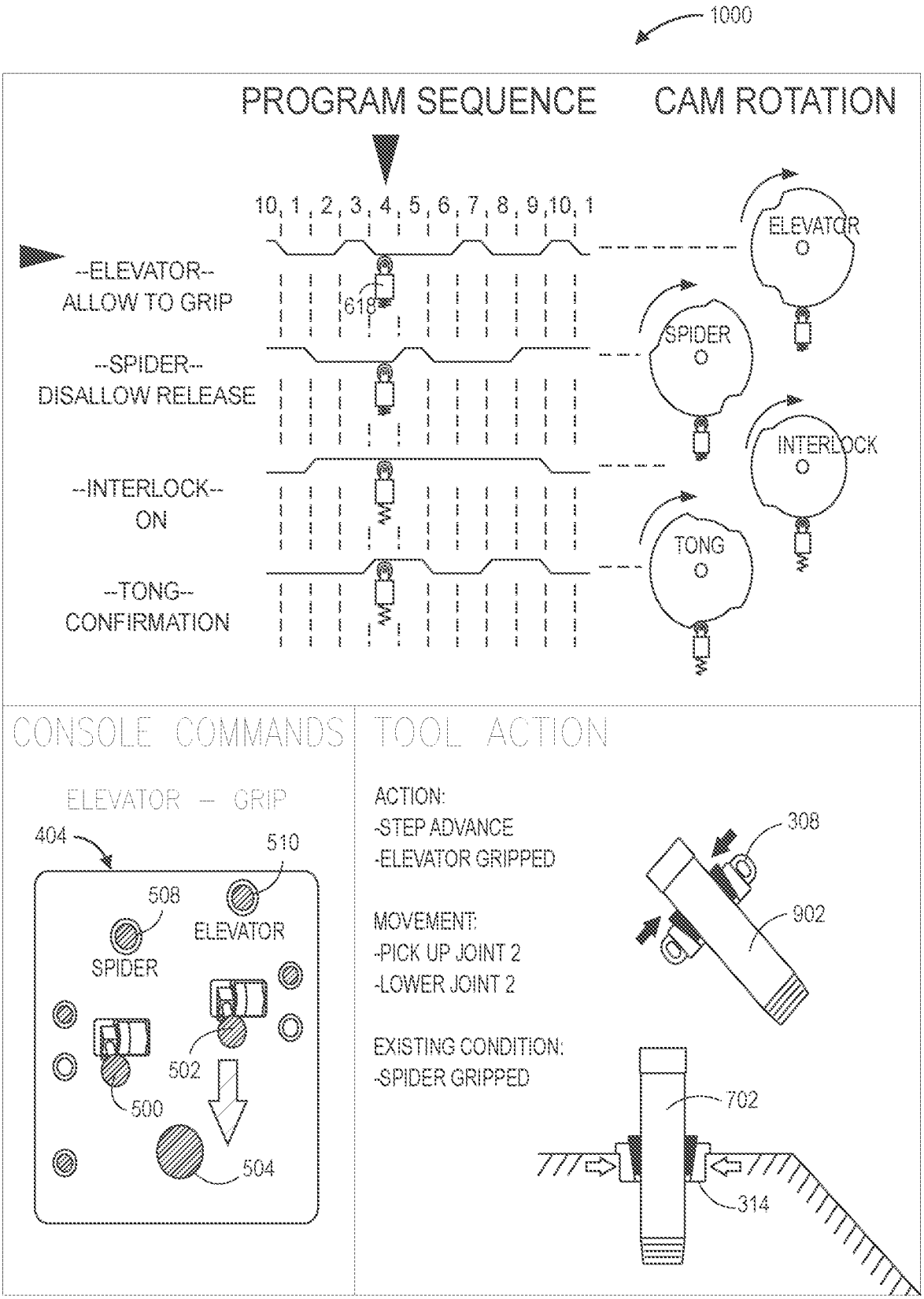

The user may then enter a command to advance step via the advance step button 504, which may be received by the system 320, which advances its program sequence to index 4, as shown at 1000 in FIG. 10. In response, the system 320 may unlock the elevator control 502. The user may then enter a command for the elevator 308 to grip the second joint 902, which the system 320 may cause the drilling rig 300 may implement. The method may then include locking the elevator control 502 and hoisting the second joint 902 using the elevator 308, from the non-vertical position to a vertical position over the first joint 702. A feedback signal may be received, indicating that the elevator 308 is gripping the second joint. The second joint 902 may then be lowered toward the first joint 702, which is secured in the spider 314, until the pin end of the second joint 902 is boxed (or stabbed, e.g., brought into contact with) the box end of the first joint 702.

Figure 11:
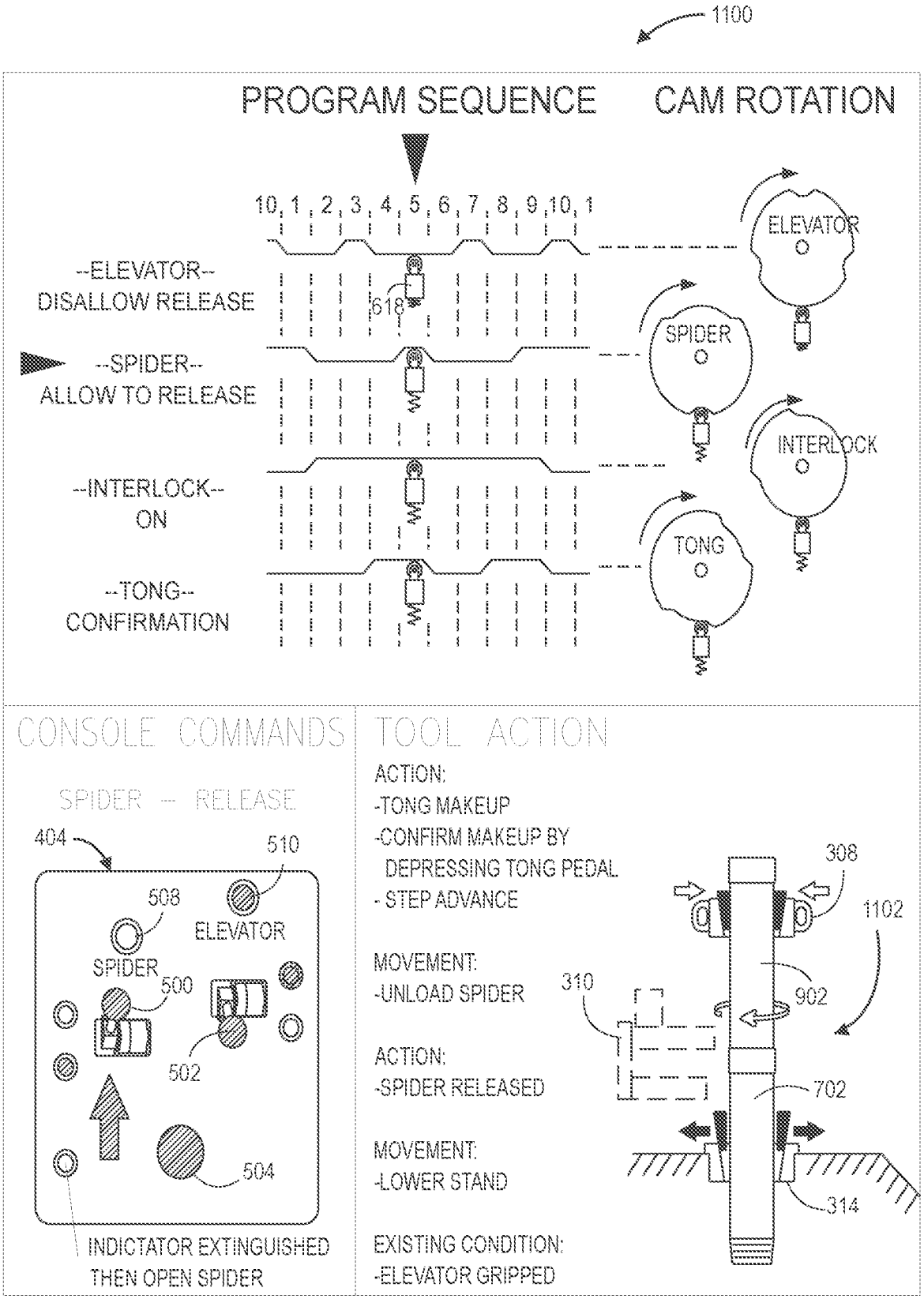
Figure 12:
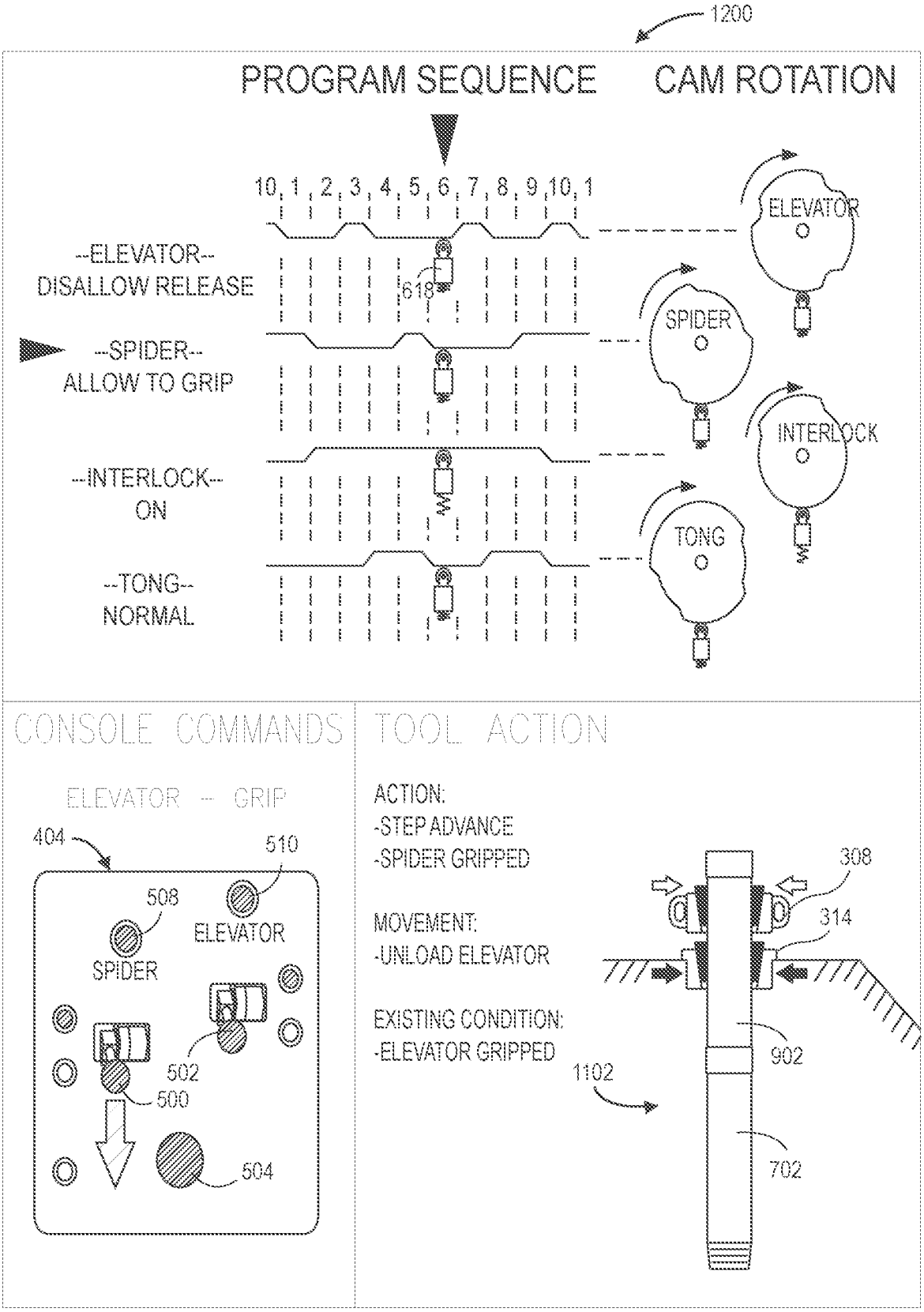
Figure 13:
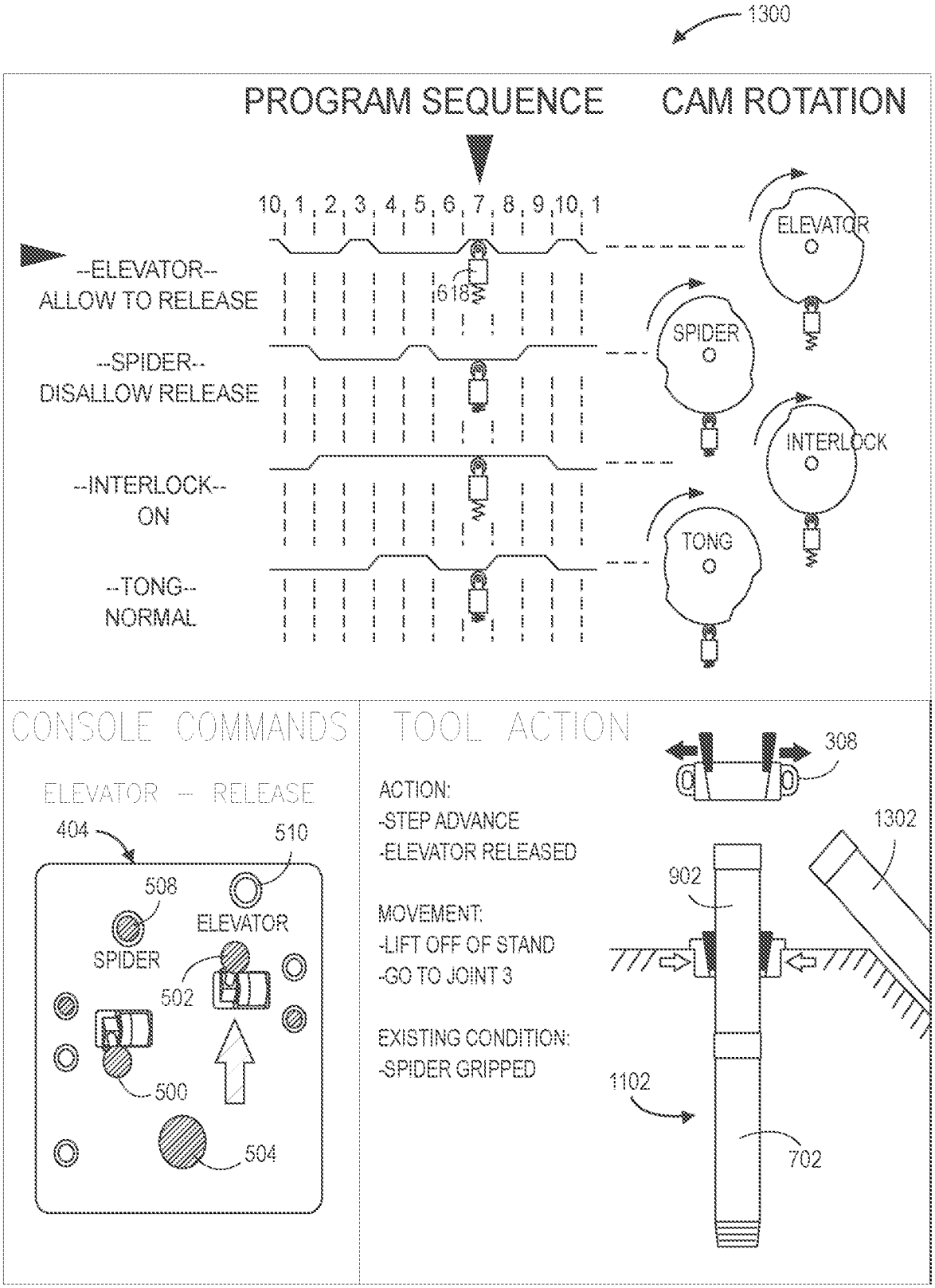

The method may then include receiving a command to advance step, e.g., again from a human operator/user via the advance step button 504. In response, the system 320 may advance to program sequence 1100, index 5, as shown in FIG. 11. At this stage, the method may include making the first joint 702 up to the second joint 902. The tong operator may conduct this action, in some embodiments, and the tong or connection make-up monitoring computer operator may confirm successful make-up, via a human feedback command from some outside device such as a foot pedal sent to the system, signal received in the system. In response to the feedback that the connection has been properly made-up, the spider control 502 may be unlocked, and then operated to open the spider 314. The spider control 500 may again be locked, and a feedback signal from the spider 314 may indicate that the spider 314 is no longer gripping the tubular.

With the elevator and spider controls 500, 502 locked, the spider 314 open, and the elevator 308 closed and supporting the weight of the first and second joints 702, 902 (connected together to make a partial stand 1102), the method may include lowering the partial stand 1102 into the mousehole, through the open spider 314, until the elevator 308 is again lowered to a position closely proximal to (directly above) the spider 314.

Once the elevator 308 is positioned, the method may receive a command to advance step, e.g., as entered by an operator. In response, the system 320 may move to index 6, as shown in program sequence 1200 in FIG. 12. At this stage, the method may include the system 320 unlocking the spider control 500. The method may then include receiving a command to close the spider 314, e.g., from an operator via the spider control 500, and the rig 300 may close the spider 314 such that the spider 314 again engages the partial stand 1102, this time at the second joint 902. The spider control 500 may then be locked, and the spider 314 may respond to the system 320, such that the system 320 receives a feedback signal indicating the spider 314 is closed and effectively gripping.

With the spider 314 engaged on the partial stand 1102, the weight may be transferred thereto and the elevator 308 may release and be removed therefrom. Accordingly, the method may include the system receiving a command to advance a step, e.g., via the advance step button 504. In response, the system 320 may advance to index 7, as shown in program sequence 1300 of FIG. 13. In this index, system 320 may unlock the elevator control 502. The system may then receive a command to open the elevator 308, which command may be entered via the unlocked elevator control 502. In response, the rig 300 may open the elevator 308, and then lock the elevator control 502. A feedback signal from the elevator 308 may indicate that the elevator 308 is open. With the elevator 308 disengaged from the second joint 902, the elevator may be removed from the second joint 902 and placed on a third joint 1302 that is in the non-vertical position.

Figure 14:
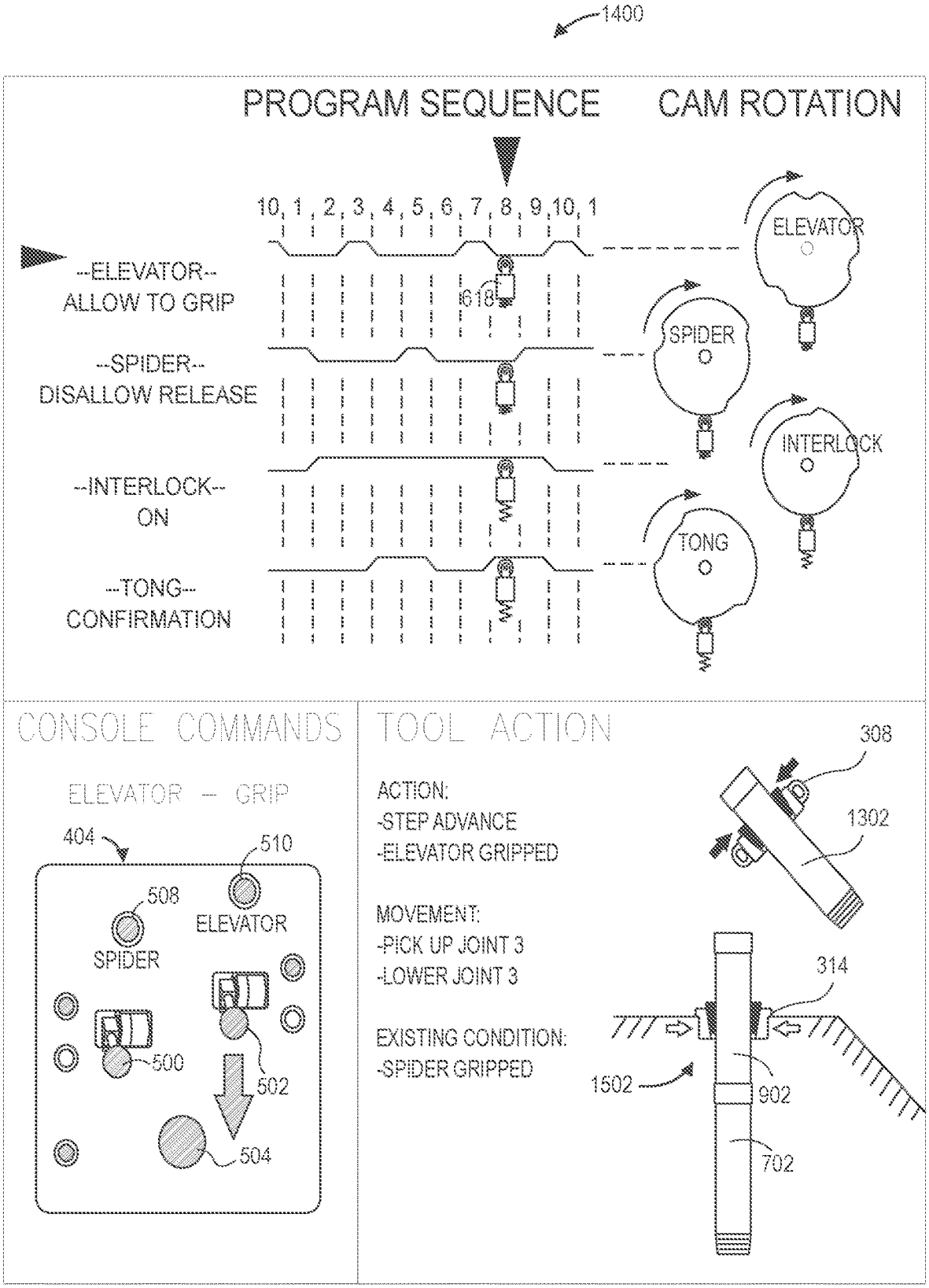

Proceeding to FIG. 14, the method may include receiving a command to advance step, e.g., from a human operator via the advance step button 504. In response, the system 320 may move to the $8^{th}$ index, as indicated in the program sequence 1400. As a result, the system 320 may unlock the elevator control 500. A user may then enter a command to close the elevator 308, which may in turn be closed, thereby causing the elevator 308 to grip the third joint 1302. The elevator control 502 may then be locked, and a feedback signal may be received indicating that the elevator 308 is closed.

The method may then proceed to hoisting the third joint 1302 from the non-vertical position to the vertical position above the second joint 902. The elevator 308 may then lower the third joint 1302 toward the second joint 902, so as to box the lower end of the third joint 1302 in the second joint 902.

Figure 15:
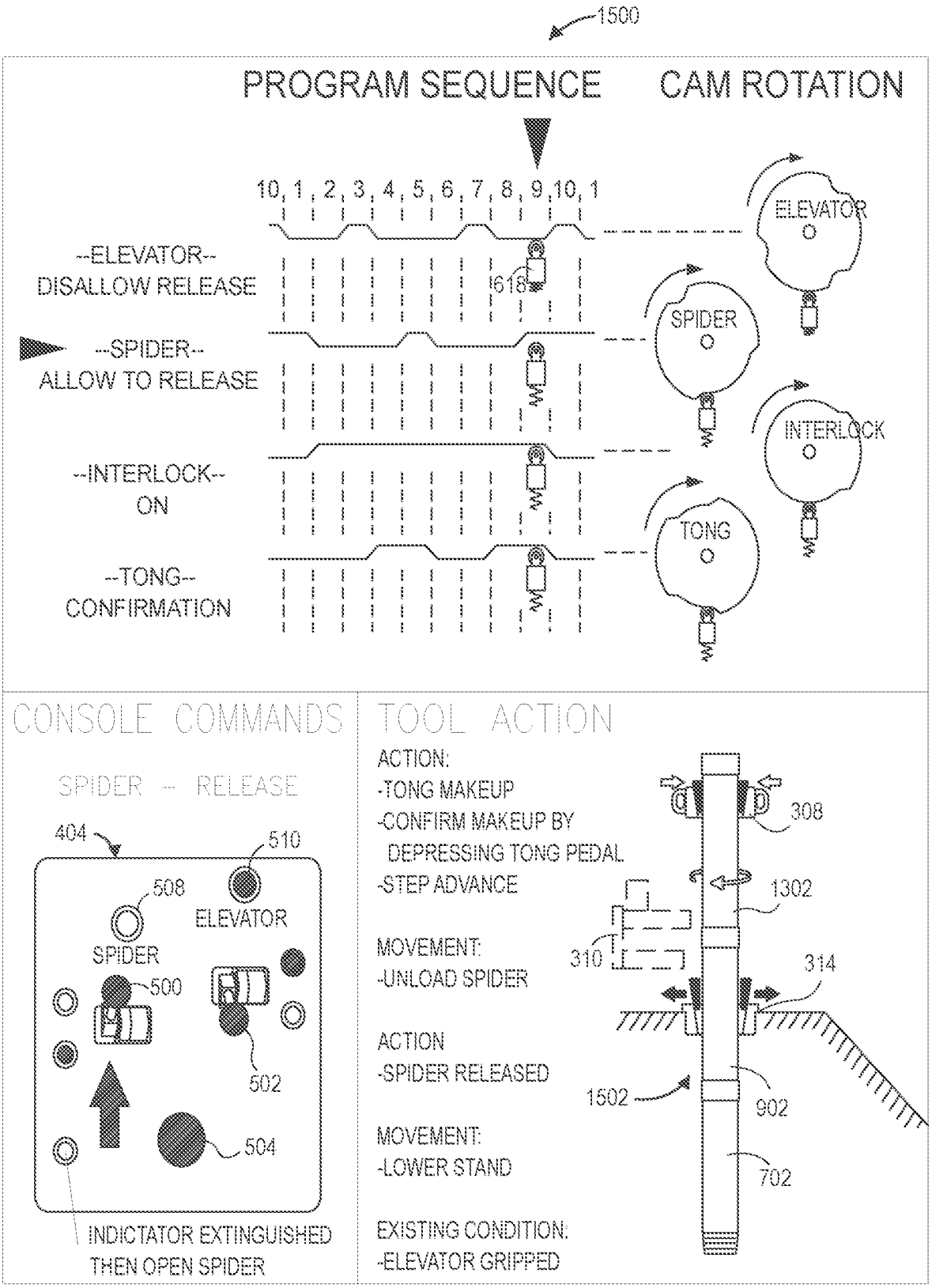

Proceeding to FIG. 15, the method may proceed to the system 320 receiving a command to advance step, e.g., from a human operator. The system 320 may then advance to index 9, as at program sequence 1500. Accordingly, the method may proceed to making up the second and third joints 902, 1302, and receiving a feedback signal indicating that makeup was successful, e.g., via human feedback command to the system 320. The result may be a completed stand 1502. The weight of the stand 1502 may be transferred to the elevator 308. At this point, the spider control 500 may be unlocked. A command is then received to open the spider 314, and the spider 314 is opened in response. The spider control 500 may then be locked. A feedback signal may then indicate that the spider 314 is open.

Figure 16:
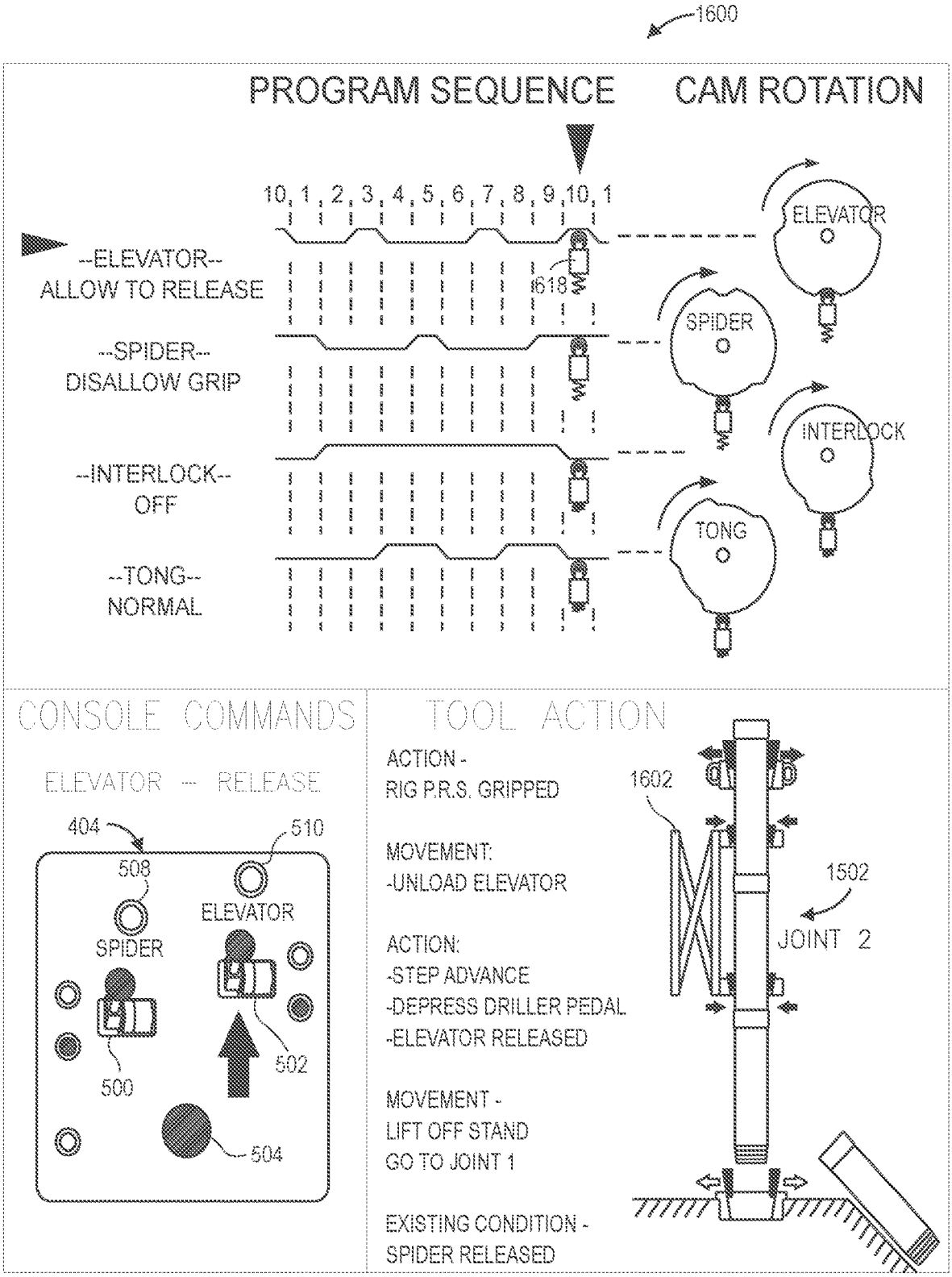

Proceeding to FIG. 16, with the spider 314 opened, the elevator 308 closed, and both controls 500, 502 locked, the stand may be hoisted out of the spider 314 by operation of the elevator 308. The stand may then be handed off to the rig's pipe racking system 1602. This may proceed by the rig's pipe racking system 1602 engaging the stand.

The method may then include receiving a command to advance step, e.g., from a human operator, moving the system 320 to the $10^{th}$ index as shown in the program sequence 1600. The elevator control may be unlocked in response. The system may temporarily disable the interlock system and place the controls in bypass mode so that both the elevator 308 and the spider 314 can be opened. The interlock may be re-enabled later when the elevator 308 is closed as the next stand building sequence begins. The rig 300 may then open the elevator 308 to remove the elevator 308 from the stand 1502, e.g., in response to a command to open the elevator from a human operator. The system 320 may then lock the elevator control 502. A feedback signal from the elevator 308 may indicate that the elevator is open. The method may then proceed to receiving a command to advance a step, e.g., from a human operator. This may result in the system 320 indexing back to index 1, as shown in FIG. 7, such that the rig 300 may be prepared to begin building a new stand, and thus opening the spider 314 and the elevator 308. The method may then be repeated to build subsequent stands.

Although a method for building a triple (three-joint stand) is disclosed, it will be readily appreciated that this method may be extended to building doubles, quads, or stands of any number of joints. During the stand-building process, either an open/close actuation of the elevator's control handle 500 is locked, or an open/close actuation of the spider's control handle 502 is locked, or both control handles are locked.

It will be appreciated that the drum 408 may be substituted or used in connection with a digital logic controller of any suitable type, and, e.g., may be coupled to actuators that control valves. For such a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

Computer-Implementation of a Sequential Step Control System

The system and methods can be mechanically implemented, e.g., using a rotating drum in a physical system that receives commands from an operator, as discussed above. Other implementations may include software controls, in which a computer applies the same or similar logic as the drum, and signals valve actuators to position valves accordingly to permit or block actuation of shifting control handles that actuate the tubular running equipment. Thus, it will be appreciated that execution of the methods disclosed herein may be effected using mechanical or electrical systems.

In some embodiments, the sequential step control system 320 may be implemented in software, hardware, or any combination thereof of a computer processing system. For example, the rules that enforce the methods discussed above may be implemented in computer-readable code. Moreover, the computer processing system may be configured to communicate with a display, such as the control panel 404, so as to allow or disallow manipulation of the handles 500, 502, similar to the drum 400. In another embodiment, the computer processing system may provide a display, such as a touch screen, which may disable actuation buttons digitally, enabling them only in the appropriate sequence.

Figure 17:
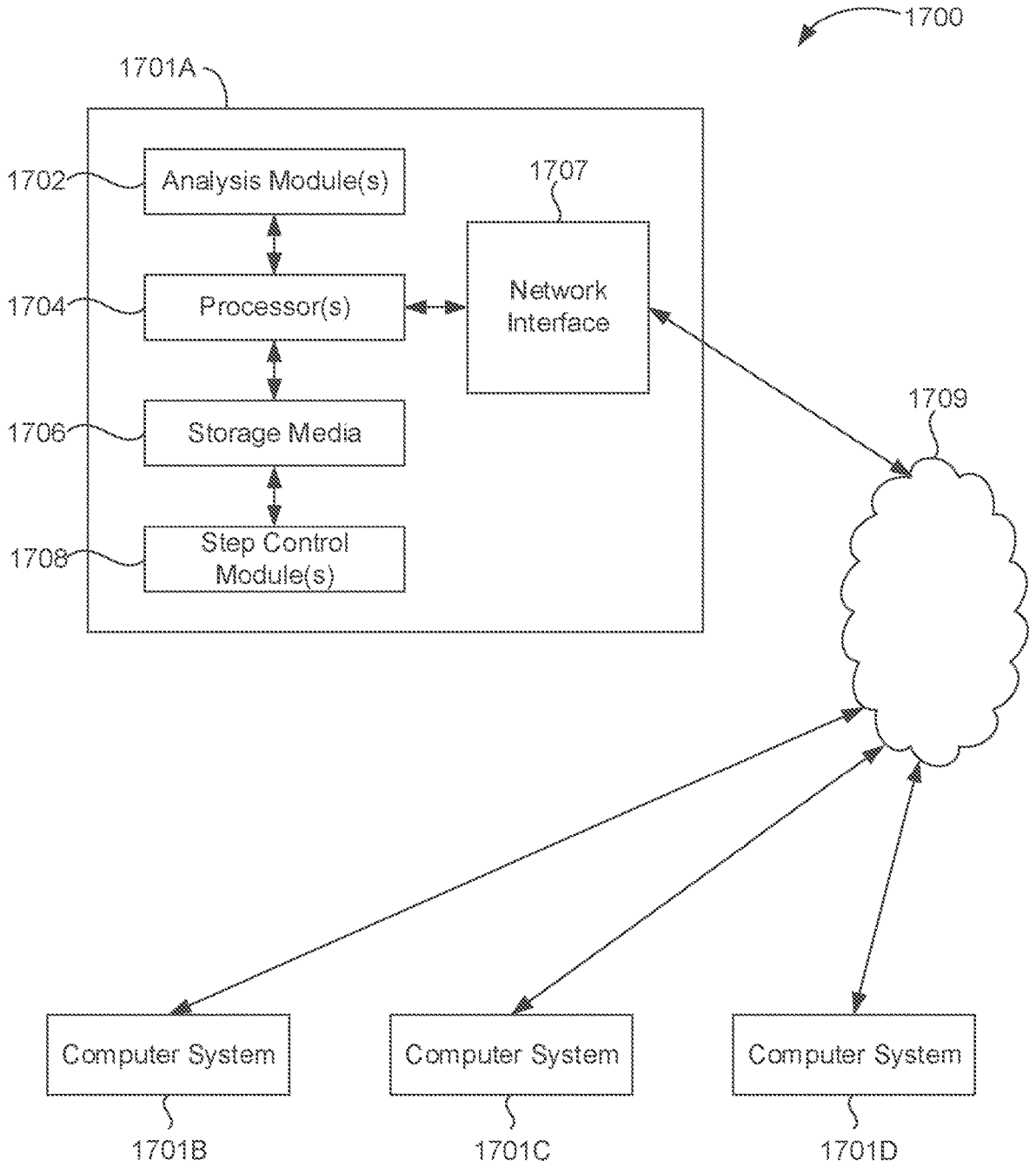
FIG. 17 illustrates another embodiment of the sequential step control system (e.g., as a computer processor).
Figure 18A:
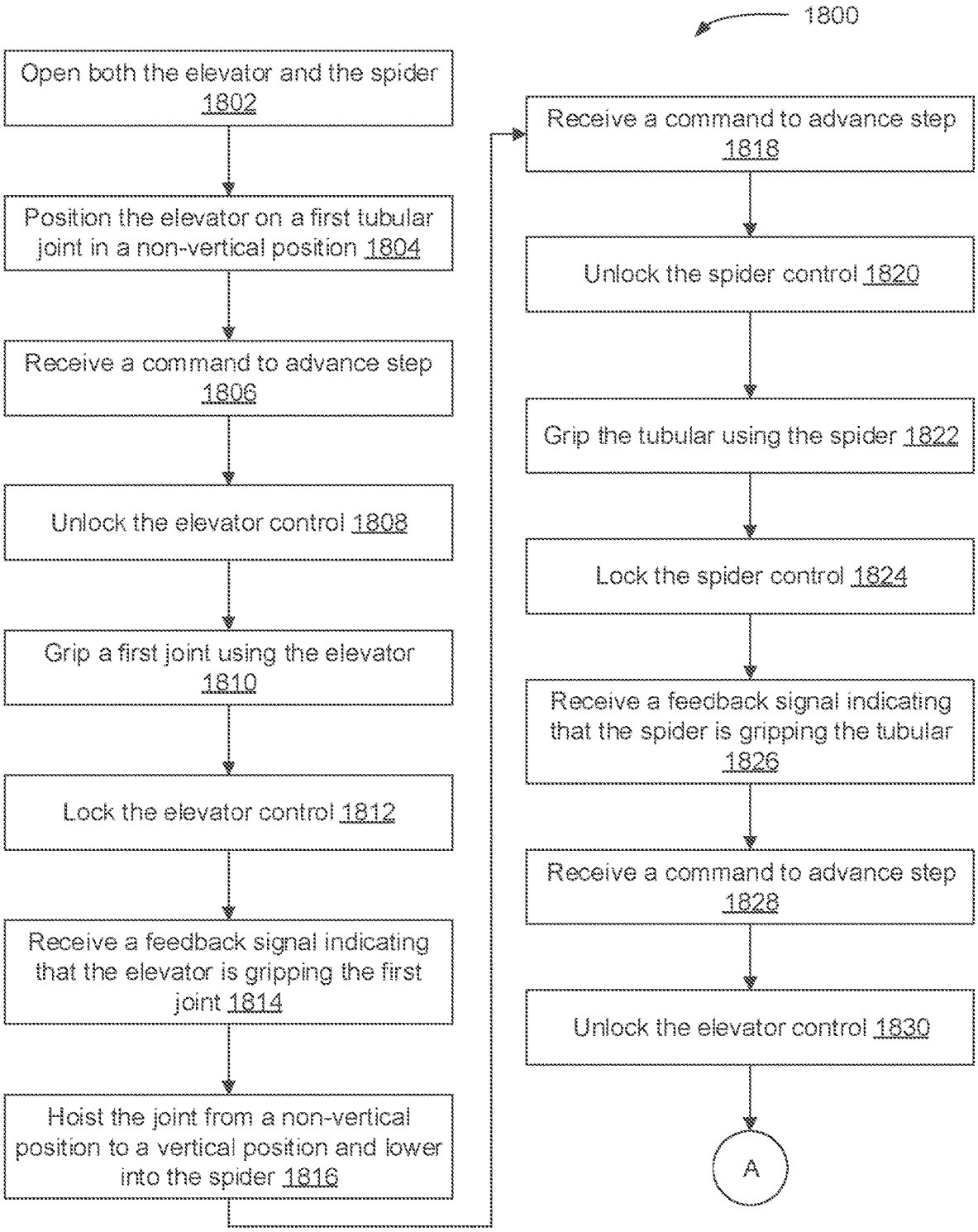
FIGS. 18A-18D illustrate a flowchart of a method for controlling a drilling rig, e.g., to build or disassemble stands of tubulars, according to an embodiment.
Figure 18B:
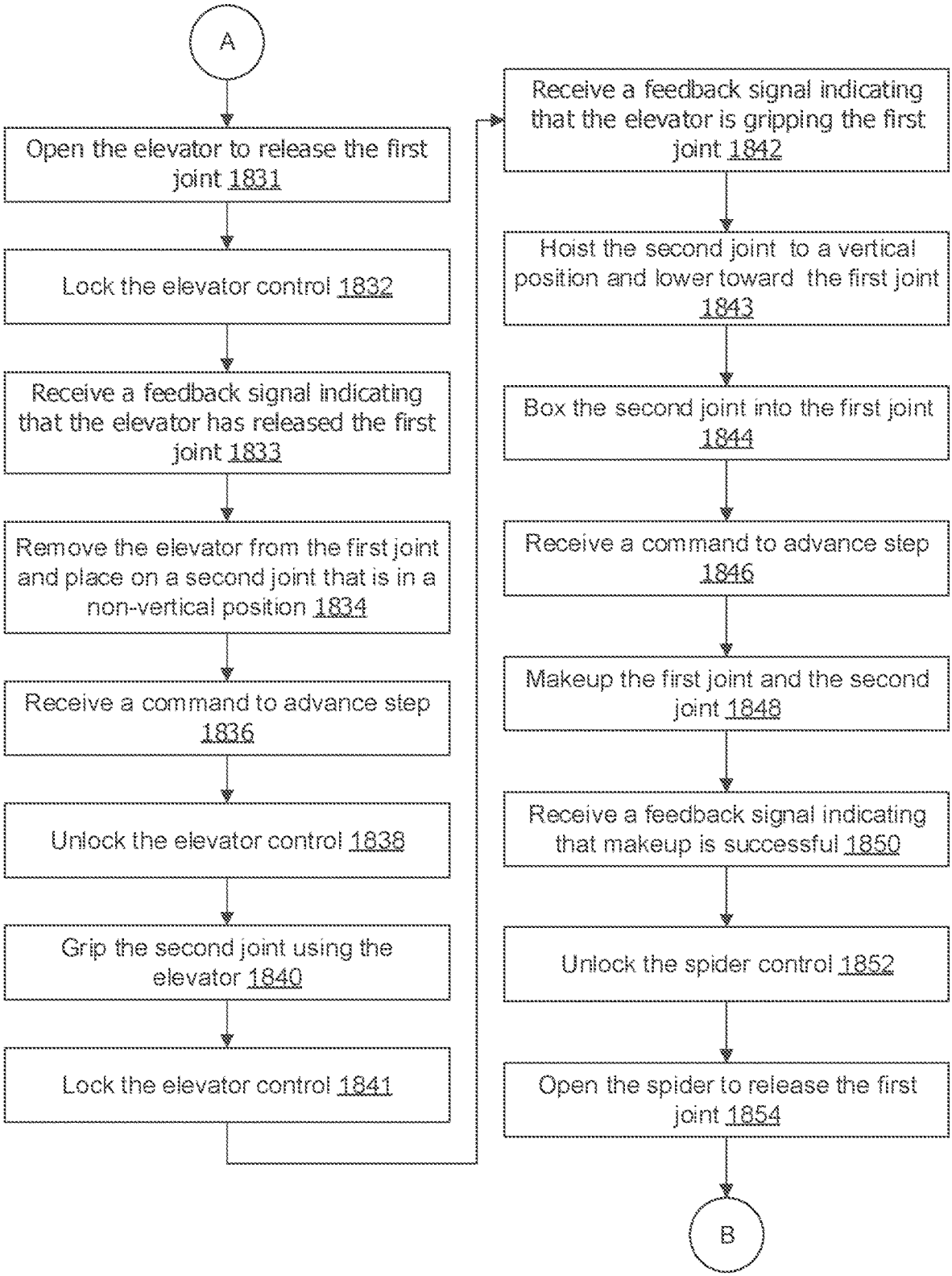
Figure 18C:
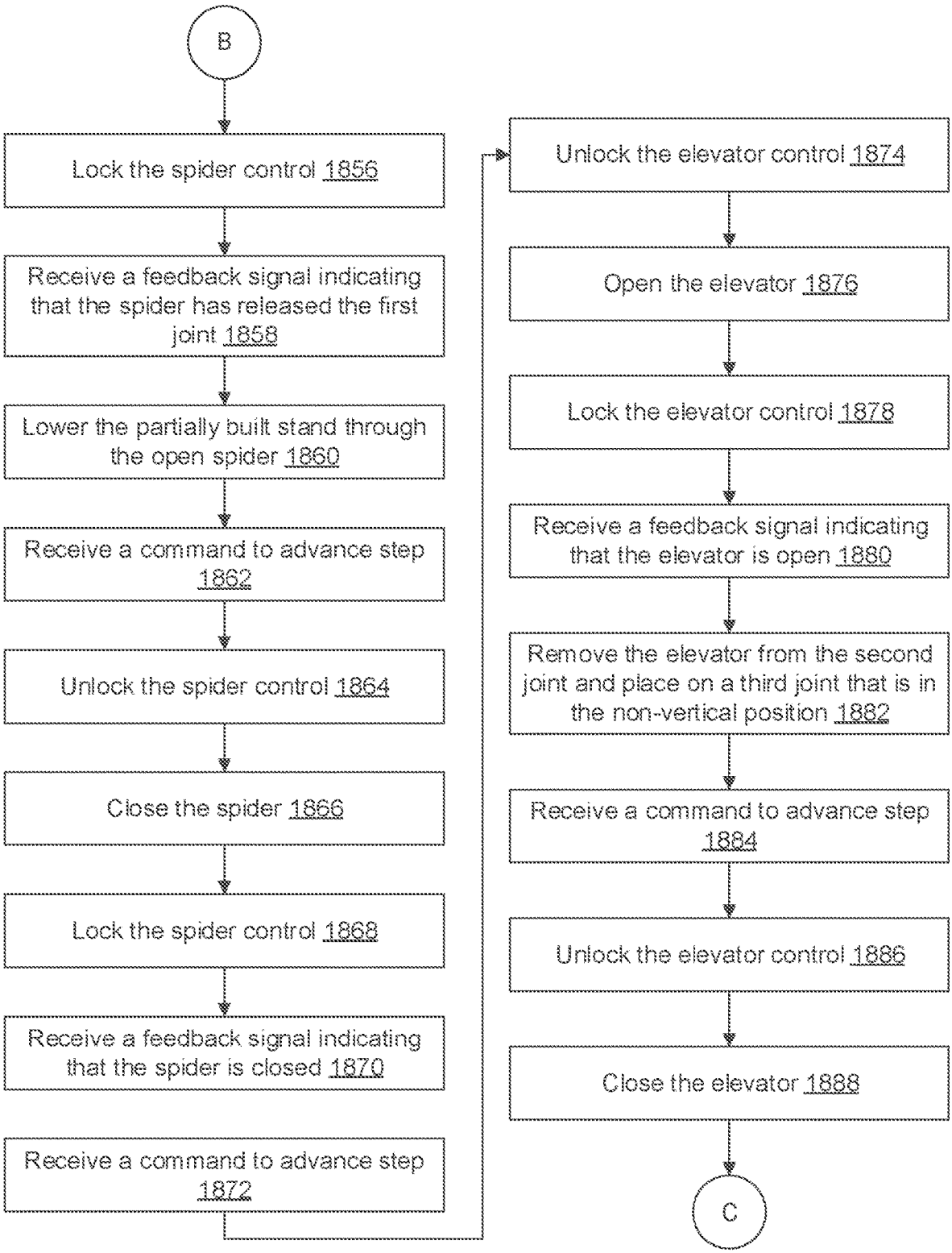
Figure 18D:
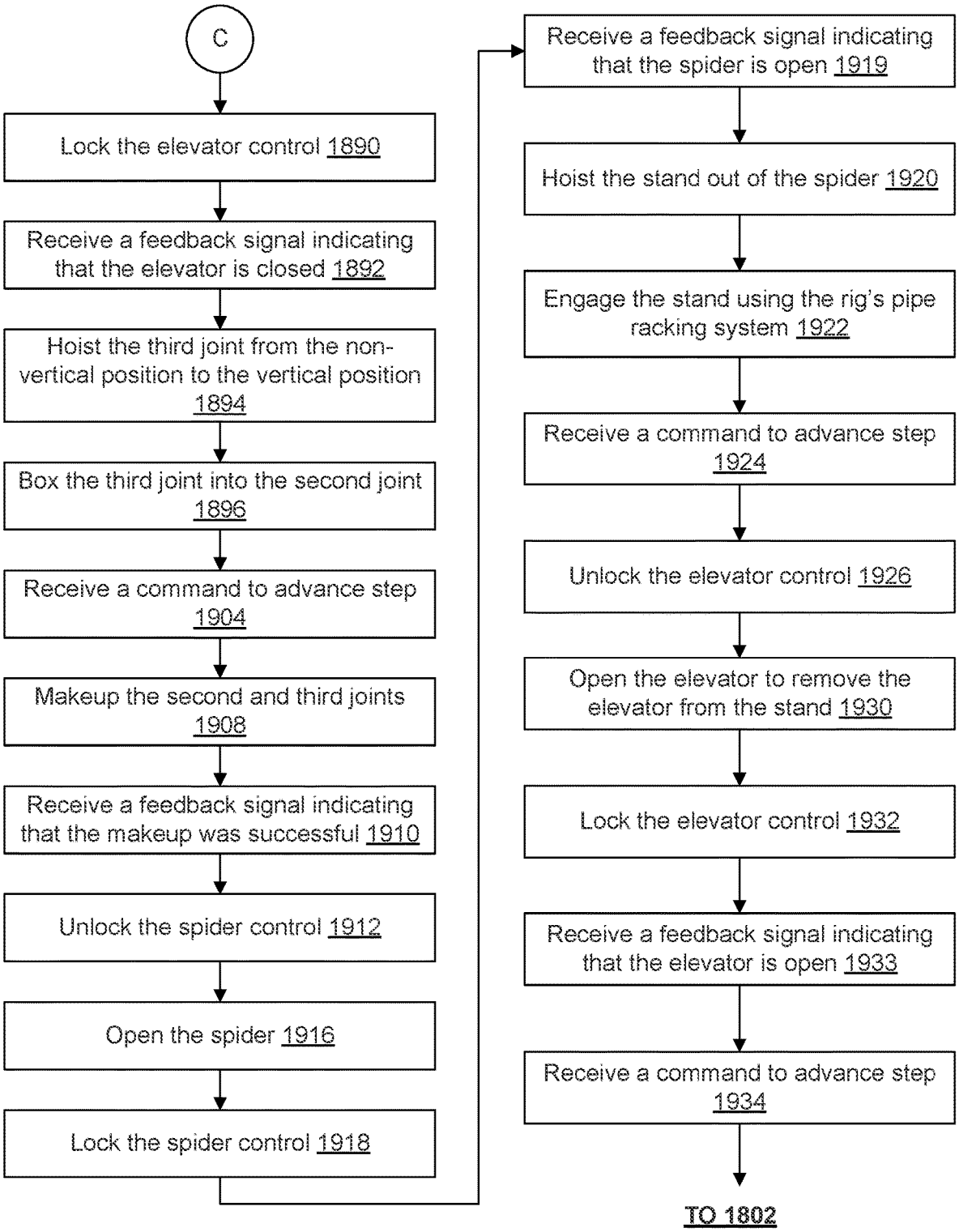

FIG. 17 illustrates an example of such a computing system 1700, in accordance with some embodiments. The computing system 1700 may include a computer or computer system 1701A, which may be an individual computer system 1701A or an arrangement of distributed computer systems. The computer system 1701A includes one or more analysis module(s) 1702 configured to perform various tasks according to some embodiments, such as one or more methods disclosed herein. To perform these various tasks, the analysis module 1702 executes independently, or in coordination with, one or more processors 1704, which is (or are) connected to one or more storage media 1706. The processor(s) 1704 is (or are) also connected to a network interface 1707 to allow the computer system 1701A to communicate over a data network 1709 with one or more additional computer systems and/or computing systems, such as 1701B, 1701C, and/or 1701D (note that computer systems 1701B, 1701C and/or 1701D may or may not share the same architecture as computer system 1701A, and may be located in different physical locations, e.g., computer systems 1701A and 1701B may be located in a processing facility, while in communication with one or more computer systems such as 1701C and/or 1701D that are located in one or more data centers, and/or located in varying countries on different continents).

A processor can include a microprocessor, microcontroller, processor module or subsystem, programmable integrated circuit, programmable gate array, or another control or computing device.

The storage media 1706 can be implemented as one or more computer-readable or machine-readable storage media. Note that while in the example embodiment of FIG. 17 storage media 1706 is depicted as within computer system 1701A, in some embodiments, storage media 1706 may be distributed within and/or across multiple internal and/or external enclosures of computing system 1701A and/or additional computing systems. Storage media 1706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 1700 contains one or more sequential step control module(s) 1708. In the example of computing system 1700, computer system 1701A includes the sequential step control module 1708. In some embodiments, a single sequential step control module may be used to perform some or all aspects of one or more embodiments of the methods. In alternate embodiments, a plurality of sequential step control modules may be used to perform some or all aspects of methods.

It should be appreciated that computing system 1700 is only one example of a computing system, and that computing system 1700 may have more or fewer components than shown, may combine additional components not depicted in the example embodiment of FIG. 17, and/or computing system 1700 may have a different configuration or arrangement of the components depicted in FIG. 17. The various components shown in FIG. 17 may be implemented in hardware, software, or a combination of both hardware and software, including one or more signal processing and/or application specific integrated circuits.

Example Method Using a Computer or Mechanical Embodiment of the Sequential Step Control System FIGS. 18A-18D illustrate a flowchart of a method 1800 for controlling a stand-building process, e.g., by controlling operation of a drilling rig (e.g., drilling rig 300 discussed above), and using a sequential step control system (computer-implemented and/or mechanically-implemented), according to an embodiment.

The method 1800 may begin by opening both the elevator and the spider, as at 1802. This may be a default starting position, and the open/close controls for both the elevator and the spider may be inoperative ("locked") at this point. Moreover, at this point, neither the elevator nor the spider are positioned around a tubular.

With the slips and elevator open, the method 1800 may proceed to positioning the elevator on a first tubular joint, which may be in a non-vertical position, as at 1804. When an operator confirms that the elevator is in position, the operator may enter a command to advance step, which may be received by the system, as at 1806. In response to receiving the command, the method 1800 may lock the spider control and unlock the elevator control, as at 1808.

With the elevator in position around the first tubular joint, and the elevator control unlocked, the method 1800 may proceed to engaging (e.g., gripping) the first joint using the elevator, by operation of the elevator control (e.g., operated by a human operator), as at 1810. Once the elevator grips the tubular joint, the elevator control may be locked, as at 1812. Further, the system may receive a feedback signal automatically (or a feedback signal may be entered by a human user in response to, e.g., visual inspection that the slips are set) indicating that the elevator is gripping the first joint, as at 1814.

In other words, in an embodiment, the open/close control of the elevator is unlocked in response to a step-advance command prior to engaging the first tubular using the elevator, and after the elevator grips the stand, control of the elevator is locked closed before hoisting the first tubular using the elevator.

The method 1800 may then include hoisting the first joint from the non-vertical position to a vertical position above the spider, and lowering the first joint through the open spider and into the mouse hole, as at 1816. Once the elevator has lowered the first joint through the spider, such that the elevator is directly above the spider, a step-advance command may be received (e.g., as entered by a user), as at 1818. In response, the method 1800 may include unlocking the spider control, as at 1820. A user, for example, may then enter a command into the system for the system to cause the spider to grip the first joint, as at 1822. This enables the weight of the first joint to be transferred from the elevator to the spider. The method 1800 also includes locking the spider control, as at 1824. A feedback signal may be provided back to the system, indicating that the spider has successfully gripped the first joint, as at 1826.

In other words, in an embodiment, the open/close control of the spider is locked while lowering the first tubular into the spider, is unlocked in response to a step-advance command prior to engaging the first tubular using the spider, and after control of the spider is locked before disengaging the elevator from the first tubular.

Further, in some embodiments, the method 1800 may include unlocking one of the open/close control of the elevator or the open/close control of the spider, but not both, in response to a step-advance command. In a specific example, unlocking the open/close control of the elevator or the open/close control of the spider includes rotating a programming drum in response to the step-advance command.

With the weight transferred, the system may receive another command to advance step (e.g., entered by a user), as at 1828. In response, the system may unlock the elevator control, as at 1830. The user may then enter a command to open the elevator, which the system may implement as at 1831, to release the elevator from the first joint. The method 1800 may then include locking the elevator control at 1832. The method 1800 may receive a feedback signal indicating that the elevator has released the first joint, as at 1833. With the elevator now open and released from the first joint, the method 1800 may proceed to removing the elevator from the first joint and placing on a second joint that is in the non-vertical position, as at 1834.

The user may then enter a command to advance step, which may be received by the system, as at 1836. In response, the system may unlock the elevator control, as at 1838. The user may then enter a command for the elevator to grip the second joint, which the system may implement at 1840. The method 1800 may then include hoisting the second joint, using the elevator, from the non-vertical position to a vertical position over the first joint, as at 1840, and then locking the elevator control, as at 1841. A feedback signal may be received at 1842, indicating that the elevator is gripping/engaging the first joint. The second joint may then be lowered toward the first joint, which is secured in the spider, until the pin end of the second joint is boxed into the box end of the first joint, as at 1843. The method 1800 may then include boxing the second joint into the first join, as at 1844.

The method 1800 may then include receiving a command to advance step, as at 1846, e.g., again from a human operator/user. In response, the method 1800 may include making the first joint up to the second joint (e.g., connecting the joints together), as at 1848. The tong operator may conduct this action, in some embodiments, and the tong or computer operator may confirm successful make-up, via a signal received in the system, as at 1850. In response to the feedback that the connection has been properly made-up, the spider control may be unlocked, as at 1852, and then operated to open the spider, as at 1854. The spider control may again be locked, as at 1856, and a feedback signal from the spider may be received, indicating that the spider is no longer gripping the tubular, and, in response, the system may lock the spider control, as at 1858.

At this point, a "double" stand of two tubulars has been made. If the application calls for a double, then the stand may be raised out of the spider and the stand-building process completed. If not, the method 1800 may proceed to adding additional joints of tubulars to the stand.

To continue adding additional lengths of tubulars to the stand, and with the elevator and spider controls locked, the spider open, and the elevator closed and supporting the weight of the first and second joints (e.g., connected together to make a partial stand), the method 1800 may include lowering the partially-built stand into the mouse hole, through the open spider, until the elevator is again lowered to a position closely proximal to (directly above) the spider, as at 1860.

Once the elevator is positioned, the method 1800 may receive a command to advance step, as at 1862. In response, the method 1800 may include the system unlocking the spider control, as at 1864. The method 1800 may then include receiving a command to close the spider, e.g., from an operator via the spider control, and the system may close the spider such that the spider again engages the partially-built stand, this time at the second joint, as at 1866. The spider control may then be locked, as at 1868, and the spider may respond to the system, such that the system receives a feedback signal indicating the spider is closed/gripping, as at 1870.

With the spider engaged on the partial stand, the weight may be transferred thereto and the elevator may be removed. Accordingly, the method 1800 may include the system receiving a command to advance a step, as at 1872. In response, the system may unlock the elevator control, as at 1874. The system may then receive a command to open the elevator, which command may be entered via the unlocked elevator control. In response, the system may open the elevator, as at 1876, and then lock the elevator control, as at 1878. The system may then receive a feedback signal indicating that the elevator is open, as at 1880. With the elevator disengaged from the second joint, the elevator may be removed from the second joint and placed on a third joint that is in the non-vertical position, as at 1882.

The method 1800 may then include receiving a command to advance step, e.g., from a human operator, as at 1884. In response, the system may unlock the elevator control, as at 1886. A user may then enter a command to close the elevator, which may in turn be closed, as at 1888, thereby causing the elevator to grip the third joint. The elevator control may then be locked, as at 1890, and a feedback signal may be received indicating that the elevator is closed, as at 1892.

The method 1800 may then proceed to hoisting the third joint from the non-vertical position to the vertical position above the second joint, as at 1894. The elevator may then lower the third joint toward the second joint, so as to stab/box/engage the lower end of the third joint in the second joint, as at 1896.

The method 1800 may proceed to the system receiving a command to advance step, as at 1904. Accordingly, the method 1800 may proceed to making up the second and third joints, as at 1908, and receiving a feedback signal indicating that makeup was successful, as at 1910. The weight of the stand may be transferred to the elevator. At this point, the spider control is unlocked, as at 1912. A command is then received to open the spider, and the spider is opened in response, as at 1916. The spider control may then be locked, as at 1918. A feedback signal may then be received, indicating that the spider is open, as at 1919.

With the spider opened, the elevator closed, and both controls locked, the stand may be hoisted out of the spider by operation of the elevator, as at 1920. The stand may then be handed off to the rig's pipe racking system. This may proceed by the rig's pipe racking system engaging the stand, as at 1922. The method 1800 may then include receiving a command to advance step, as at 1924. The elevator control may be unlocked in response, as at 1926. The system may then open the elevator to remove the elevator from the stand, as at 1930, e.g., in response to a command to open the elevator. The system may then lock the elevator control, as at 1932. A feedback signal may be received from the elevator, indicating that the elevator is open, as at 1933. The method 1800 may then proceed to receiving a command to advance a step, as at 1934. This may result in the system being prepared to building a new stand, by looking back to box 1802, and thus opening the spider and the elevator. The method 1800 may then be repeated to build another stand.

At all times during the stand-building process, defined as the time between when the elevator is ready to engage the first tubular to hoist it into position above the spider and when it is ready to be handed off to a tubular handling equipment configured to place the completed stand into (e.g., vertical) storage, either an open/close control of the elevator is locked, or an open/close control of the spider is locked, or both are locked, thereby preventing the tubular(s) being used to build the stand from being dropped from the drilling rig 300 though inadvertent control by the operator. The sequential step control system enforces such locking depending on the step of the stand-building process being performed.

To continue building a larger stand, in an embodiment, the method 1800 may also include lowering the first and second tubulars at least partially through the spider by lowering the elevator, as at 1820. The method 1800 may further include engaging the second tubular using the spider, as at 1822. The method 1800 may also include disengaging the elevator from the second tubular after engaging the second tubular using the spider, as at 1824. The method 1800 may further include hoisting and lowering a third tubular into engagement with the second tubular, as at 1826. The method 1800 may also include connecting together the second and third tubulars, as at 1828. If a "triple" stand made of three joints of tubular is called for, then the method 1800 may include hoisting a completed stand from engagement with the spider by raising the elevator, as at 1830, and engaging the completed stand using rig tubular handling equipment, as at 1830. If additional joints of tubular are called for to make a stand, then the process of adding successive tubulars may be repeated, for as many joints as called for.

After completing the stand building process, the method 1800 may include engaging the completed stand using the rig tubular handling equipment, automatically unlocking the open/close control of the elevator to allow opening of the elevator while the spider is open, and locking the open/close control of the elevator and the open/close control of the spider, as at 1832.

In some embodiments, the method 1800 may be run substantially in reverse to perform a stand-disassembly process, in which stands of two or more tubulars are broken apart using the elevator and the spider. In accordance with an embodiment of the present method, at all times during the stand-disassembly process, the sequential step control system locks the open/close control of the elevator control, or locks the open/close control of the spider control, or locks both, depending on a step of the stand-disassembly process being performed.

As used herein, the terms "inner" and "outer"; "up" and "down"; "upper" and "lower"; "upward" and "downward"; "above" and "below"; "inward" and "outward"; "uphole"

and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for controlling a stand-building process using a sequential step control system, comprising:

engaging a first tubular using an elevator;

hoisting the first tubular by raising the elevator;

lowering the first tubular into a spider by lowering the elevator;

engaging the first tubular using the spider;

disengaging the first tubular from the elevator after engaging the first tubular using the spider;

engaging a second tubular using the elevator;

hoisting and lowering the second tubular into engagement with the first tubular;

connecting together the first and second tubulars;

disengaging the spider from the first tubular after connecting together the first and second tubulars, wherein, at all times during the stand-building process, the sequential step control system locks an open/close control of the elevator, or locks an open/close control of the spider, or locks both, depending on a step of the stand-building process being performed; and after completing the stand-building process:

hoisting a completed stand from engagement with the spider by raising the elevator; and engaging the completed stand using rig tubular handling equipment, automatically disabling an interlock function temporarily and unlocking the open/close control of the elevator to allow opening of the elevator while the spider is open, and locking the open/close control of the elevator and the open/close control of the spider.

2. The method of claim 1, further comprising:

lowering the first and second tubulars through the spider by lowering the elevator;

engaging the second tubular using the spider;

disengaging the elevator from the second tubular after engaging the second tubular using the spider;

hoisting and lowering a third tubular into engagement with the second tubular; and connecting together the second and third tubulars.

3. The method of claim 1, wherein the stand-building process begins when the elevator is ready to be positioned on the first tubular, and ends when a completed stand is engaged by the rig tubular handling equipment.

4. The method of claim 1, wherein the open/close control of the elevator is unlocked in response to a step-advance command prior to engaging the first tubular using the elevator, and after the elevator grips the first tubular, control of the elevator is locked closed before hoisting the first tubular using the elevator.

5. The method of claim 1, wherein the open/close control of the spider is locked while lowering the first tubular into the spider, is unlocked in response to a step-advance command prior to engaging the first tubular using the spider, and after control of the spider is locked before disengaging the elevator from the first tubular.

6. The method of claim 1, further comprising unlocking one of the open/close control of the elevator or the open/close control of the spider, but not both, in response to a step-advance command.

7. The method of claim 6, wherein unlocking the open/close control of the elevator or the open/close control of the spider comprises rotating a programming drum in response to the step-advance command.

8. The method of claim 7, wherein rotating the programming drum comprises engaging valve actuators with camming surfaces of the programming drum, wherein the camming surfaces engaging the valve actuators causes one or more valves to actuate, and wherein the one or more valves actuating unlocks the open/close control of the elevator or the open/close control of the spider.

9. The method of claim 7, further comprising receiving a closed/gripped feedback signal from the elevator or the spider, and unlocking the open/close control of the elevator or the spider in response.

10. The method of claim 9, wherein receiving the step-advance command actuates a run actuator coupled to the programming drum in a first direction, the method further comprising actuating the run actuator in a second direction in response to receiving the closed/gripped signal, wherein a cycle of actuating the run actuator once in the second direction to reset to engagement and not cause drum rotation and once in the first direction causes the programming drum to rotate a single indexing step, and wherein the programming drum rotating changes which valves actuators are actuated.

11. The method of claim 1, further comprising performing a stand-disassembly process to disassemble one or more stands using the elevator and the spider, wherein, at all times during the stand-disassembly process, the sequential step control system locks the open/close control of the elevator control, or locks the open/close control of the spider control, or locks both, depending on a step of the stand-disassembly process being performed.

12. A computer system for controlling a stand-building process, the system comprising:

one or more processors; and a memory system comprising one or more non-transitory, computer-readable media storing instructions that, when executed by the processor, cause the system to perform operations, the operations comprising:

engaging a first tubular using an elevator;

hoisting the first tubular by raising the elevator;

lowering the first tubular into a spider by lowering the elevator;

engaging the first tubular using the spider;

disengaging the first tubular from the elevator after engaging the first tubular using the spider;

engaging a second tubular using the elevator;

hoisting and lowering the second tubular into engagement with the first tubular;

connecting together the first and second tubulars;

disengaging the spider from the first tubular after connecting together the first and second tubulars, wherein, at all times during the stand-building process, either an open/close control of the elevator is locked, or an open/close control of the spider is locked, or both are locked; and after completing the stand-building process:

hoisting a completed stand, comprising at least the first and second tubulars, from engagement with the spider by raising the elevator; and engaging the completed stand using rig tubular handling equipment, automatically unlocking the open/close control of the elevator to allow opening of the elevator while the spider is open, and locking the open/close control of the elevator and the open/close control of the spider.

13. The system of claim 12, wherein the operations further comprise:

lowering the first and second tubulars through the spider by lowering the elevator;

engaging the second tubular using the spider;

disengaging the elevator from the second tubular after engaging the second tubular using the spider;

hoisting and lowering a third tubular into engagement with the second tubular; and connecting together the second and third tubulars.

14. The system of claim 12, wherein:

the open/close control of the elevator is unlocked in response to a step-advance command prior to engaging the first tubular using the elevator, and after the elevator grips the first tubular, control of the elevator is locked closed before hoisting the first tubular using the elevator; and the open/close control of the spider is locked while lowering the first tubular into the spider, is unlocked in response to a step-advance command prior to engaging the first tubular using the spider, and after control of the spider is locked before disengaging the elevator from the first tubular.

15. The system of claim 14, wherein the operations further comprise unlocking one of the open/close control of the elevator or the open/close control of the spider, but not both, in response to a step-advance command.

* * * * *